US010311670B2

(12) United States Patent
Brahmandam et al.

(10) Patent No.: US 10,311,670 B2
(45) Date of Patent: Jun. 4, 2019

(54) MACHINE-LEARNING PLATFORM FOR OPERATIONAL DECISION MAKING

(71) Applicant: Gaming Analytics Inc, San Rafael, CA (US)

(72) Inventors: Kiran Brahmandam, San Rafael, CA (US); Matthew Parker, San Rafael, CA (US); Kurt Ruegg, San Rafael, CA (US); Krishnan Srinivasan, Chennai (IN); Andrealiz Afable, Daly City, CA (US)

(73) Assignee: Gaming Analytics Inc, San Rafael, CA (US)

( * ) Notice: Subject to any disclaimer, the term of this patent is extended or adjusted under 35 U.S.C. 154(b) by 0 days.

(21) Appl. No.: 16/028,865

(22) Filed: Jul. 6, 2018

(65) Prior Publication Data

US 2019/0012876 A1 Jan. 10, 2019

Related U.S. Application Data

(60) Provisional application No. 62/530,131, filed on Jul. 8, 2017.

(51) Int. Cl.
*G07F 17/32* (2006.01)

(52) U.S. Cl.
CPC ..... *G07F 17/3234* (2013.01)

(58) Field of Classification Search
CPC ..... A63F 9/24; G07F 17/32; G07F 17/3234
See application file for complete search history.

(56) References Cited

U.S. PATENT DOCUMENTS 6,517,435 B2 * 2/2003 Soltys ..... G06Q 10/0639 273/148 R
7,803,047 B1 * 9/2010 Green ..... G07F 17/32 463/16
2004/0024666 A1 * 2/2004 Walker ..... G06Q 30/0218 705/32
2006/0199649 A1 * 9/2006 Soltys ..... G06Q 10/0639 463/47
2006/0217194 A1 * 9/2006 Walker ..... G07F 17/32 463/29
2008/0138773 A1 * 6/2008 Lathrop ..... G07F 17/32 434/72
2008/0261699 A1 * 10/2008 Topham ..... G07F 17/32 463/42
2009/0054139 A1 * 2/2009 Anderson ..... G07F 17/32 463/31

(Continued)

OTHER PUBLICATIONS

"Understanding Slot Machine Math Basics" by Sheryl L. Ashley, published on or before Dec. 31, 2015, printed and accessed from URL <http://www.indiangaming.com/istore/Dec15_Ashley.pdf>, 2 pages.*

(Continued)

*Primary Examiner* — Jason Skaarup
(74) *Attorney, Agent, or Firm* — Ulmer & Berne LLP

(57) ABSTRACT

A platform for providing projections, predictions, and recommendations for casino and gaming environments. The platform leverages machine learning and cognitive computing. Through a natural language interface, the platform presents this information in a way which is natural and timely for casino operational executives to understand and act upon. The platform can optimize gaming machine performance casino floor performance based on various metrics that are predicted by the platform.

26 Claims, 16 Drawing Sheets

(56) References Cited

U.S. PATENT DOCUMENTS

2009/0055205 A1* 2/2009 Nguyen ..... G06K 9/00771 463/29
2009/0070081 A1* 3/2009 Saenz ..... G07F 17/32 703/2
2010/0234104 A1* 9/2010 Ruppert ..... G07F 17/3232 463/30
2011/0081961 A1* 4/2011 Gagner ..... G07F 17/32 463/25
2011/0118007 A1* 5/2011 Gururajan ..... G07F 17/32 463/25
2011/0183732 A1* 7/2011 Block ..... G06Q 30/02 463/1
2011/0294566 A1* 12/2011 Cardno ..... G07F 17/3237 463/25
2012/0040756 A1* 2/2012 Moore, III ..... G06Q 30/02 463/32
2012/0047090 A1* 2/2012 Gunther ..... G06Q 40/06 705/36 R
2014/0080588 A1* 3/2014 Acres ..... G07F 17/32 463/25
2015/0105162 A1* 4/2015 Ruppert ..... G07F 17/00 463/42
2016/0342902 A1* 11/2016 Pinckney ..... G06Q 30/02

OTHER PUBLICATIONS

"Slot Machine Basics" by Dunn Gaming, published on or before Nov. 29, 2015, printed and accessed from URL <https://web.archive.org/web/20151129121349/http://www.dunngamingsolutions.com/files/DGT_SPA-1-2.pdf>, 19 pages.*

Young, Lee W.; International Search Report and Written Opinion of the International Searching Authority, issued in International App. No. PCT/US2018/041031; dated Oct. 3, 2018; 12 pages.

* cited by examiner

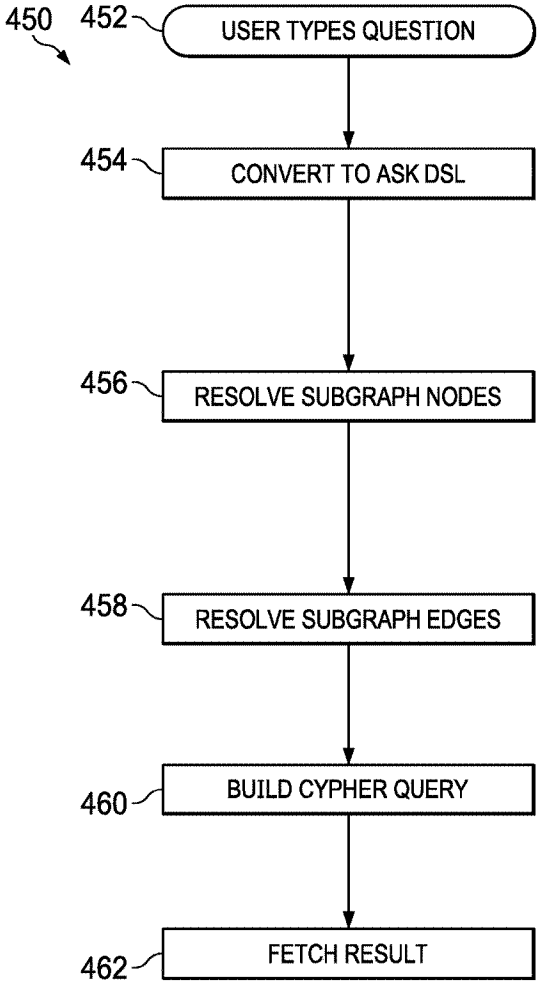

FIG. 4B

ALL SLOTS WITH NetWin GREATER THAN $10,000 THIS MONTH BY MANUFACTURER

```
query
.dimension("Slots")
.metric("assetID","netWin")
.predicate("netWin", "gt", 10,000)
.predicate("month", "eq", "2018/02")
.sortAsc("NetWin")
.groupBy ("manufacturer")
```

| NODE | PROPERTIES |
|---|---|
| ASSET | ID |
| GamePlay | NetWin |
| MANUFACTURER | NAME |
| MONTH | VALUE |

| START NODE | END NODE | EDGE |
|---|---|---|
| GamePlay | ASSET | ASSET_GAMEPLAY |
| ASSET | MANUFACTURER | ASSET_MANUFACTURED_BY |
| GamePlay | MONTH | MONTHLY_GAMEPLAY_SUMMARY |

```
MATCH (asset:Asset) - [-MANUFACTURED_BY] -> (manufacturer:Manufacturer)
MATCH (asset) - [:GAMEPLAY] -> (gameplay:GamePlay)
MATCH (month:Month) - [:MONTHLY_GAMEPLAY_SUMMARY] -> (gameplay)
WHERE month = '2018/02'
RETURN manufacturer.name, asset.id, gameplay.netWin
```

| MANUFACTURER | ASSET | NetWin |
|---|---|---|
| IGT | IGT0001 | $15,000 |
| BALLY | BAL0002 | $17,000 |

CHANGE ANALYSIS - HOW DID MY CHANGES PERFORM?

| Bank | Zone | Area | Change Day | Impact on Coin In (PUPD) | Impact on Net Win (PUPD) | Impact on Theoretical Win (PUPD) | Impact on Handle Pulls (PUPD) |
|---|---|---|---|---|---|---|---|
| 2018/01/02 | | | | | | | |
| ⊕ 142 | 6 | 1 | 2018/01/02 | -$34,695 | $16,782 | -$66 | 10,418 |
| 2018/12/27 | | | | | | | |
| ⊕ 44 | 6 | 1 | 2017/12/27 | -$49,767 | $2,656 | -$3,523 | 2,739 |
| ⊕ 142 | 6 | 1 | 2017/12/27 | -$48,535 | $9,030 | -$669 | 9,582 |
| 2018/12/19 | | | | | | | |
| ⊕ 82 | 6 | 1 | 2017/12/19 | -$108,737 | $60,760 | -$14,904 | -5.513 |
| ⊕ 89 | 2 | 1 | 2017/12/19 | $90,699 | $3,024 | $3,009 | -2,557 |
| ⊕ 143 | 6 | 1 | 2017/12/19 | -$13,435 | -$1,266 | -$872 | -2,000 |
| ⊕ 154 | 6 | 1 | 2017/12/19 | $112,137 | $7,199 | $3,192 | -3,050 |

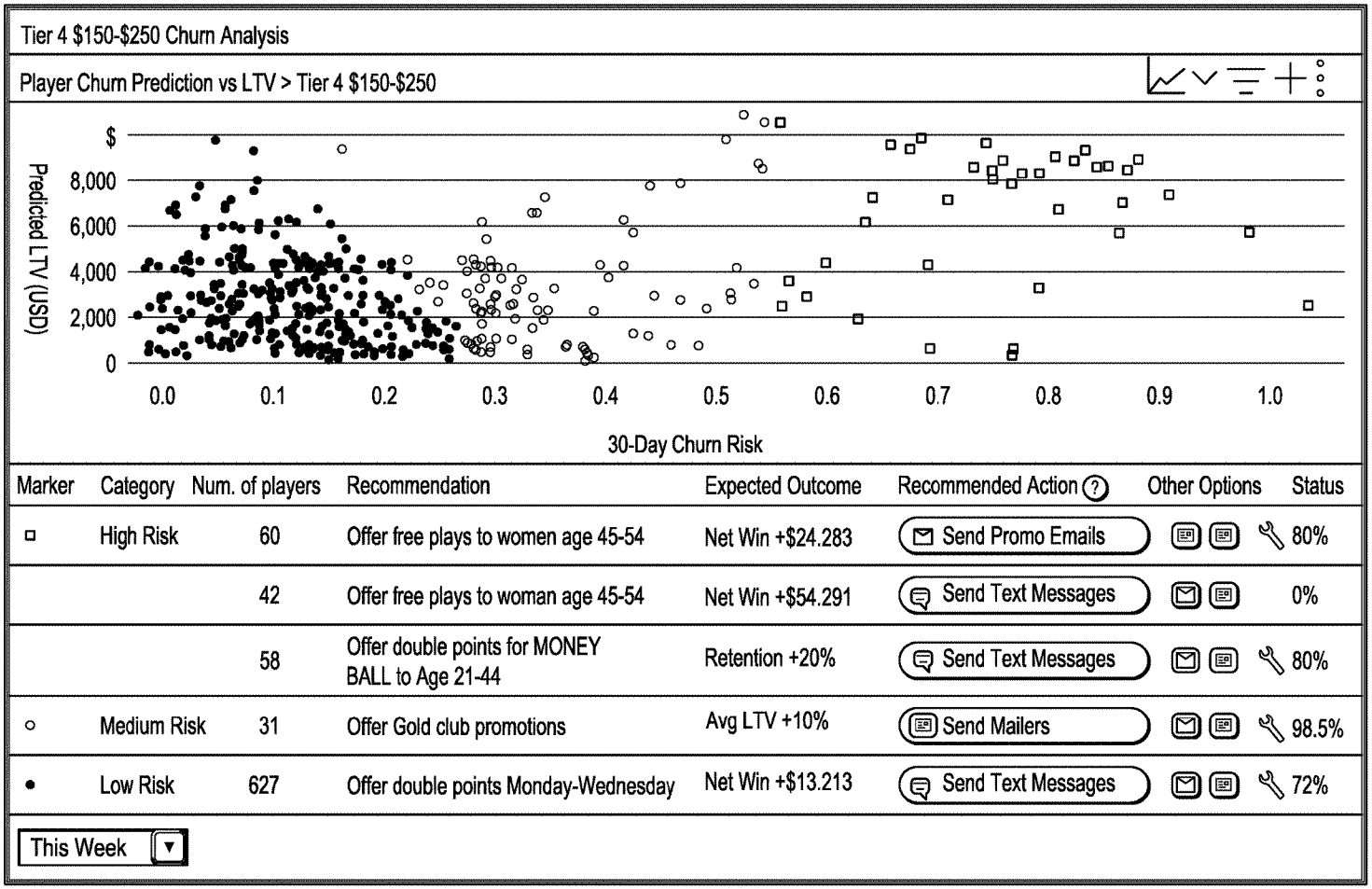

| Marker | Category | Num. of players | Recommendation | Expected Outcome | Recommended Action | Other Options | Status |
|---|---|---|---|---|---|---|---|
| □ | High Risk | 60 | Offer free plays to women age 45-54 | Net Win +$24.283 | Send Promo Emails | | 80% |
| | | 42 | Offer free plays to woman age 45-54 | Net Win +$54.291 | Send Text Messages | | 0% |
| | | 58 | Offer double points for MONEY BALL to Age 21-44 | Retention +20% | Send Text Messages | | 80% |
| ○ | Medium Risk | 31 | Offer Gold club promotions | Avg LTV +10% | Send Mailers | | 98.5% |
| • | Low Risk | 627 | Offer double points Monday-Wednesday | Net Win +$13.213 | Send Text Messages | | 72% |

FIG. 13

MACHINE-LEARNING PLATFORM FOR OPERATIONAL DECISION MAKING

CROSS-REFERENCE TO RELATED APPLICATION

This application claims the benefit of U.S. Provisional Application No. 62/530,131, entitled "A Machine-Learning Driven Platform for Operational Decision Making," filed Jul. 8, 2017, the disclosure of which is hereby incorporated herein by reference in its entirety.

BACKGROUND

Gaming machines, such as slot machines, poker machines, and the like, provide a source of revenue for gaming establishments. A large gaming casino typically employs thousands of gaming machines that can be operated simultaneously. Currently, casino floors include a wide variety of electronic gaming machines, such as video slot machines, poker machines, reel slot machines and other gaming machines. A central line of questioning for casino operational executives is ensuring the correct balance, or mix, of machines exist on the floor, according to some natural division like manufacturer or cabinet type. This has historically done by comparing percentage contribution to some important metric like net win for each category within the division to the percentage of machines within that category. The most common action based on this information is to add additional machines from the category with the highest ratio and removing machines from the category with the lowest. This approach, however, suffers from the implicit assumption that demand for machines of that category is relatively linear in the size of the category, which is often not the case for various classes of machines and play. Thus, while casino operators have access to a wide array of information from various data sources, the challenge is to create context and insights from this information.

Current offerings that are designed to assist casino operators with operational decisioning focus on data and not context or insights. Further, future machine performance of specific machine key performance indicators (KPIs) is most commonly predicted with a linear trend line, generated through a simple statistical process like linear regression on recent historical performance. More advanced methods might utilize basic time series methods to remove seasonality before regressing, but these approaches are extremely simplistic and often yield poor predictions.

BRIEF DESCRIPTION OF THE DRAWINGS

The present disclosure will be more readily understood from a detailed description of some example embodiments taken in conjunction with the following figures:

FIGS. 4A-4B depicts example workflow in accordance with the present disclosure.

FIGS. 7-14 depict example non-limiting interfaces that can be presented by a gaming analytics computing system according to various embodiments.

DETAILED DESCRIPTION

Figure 1:
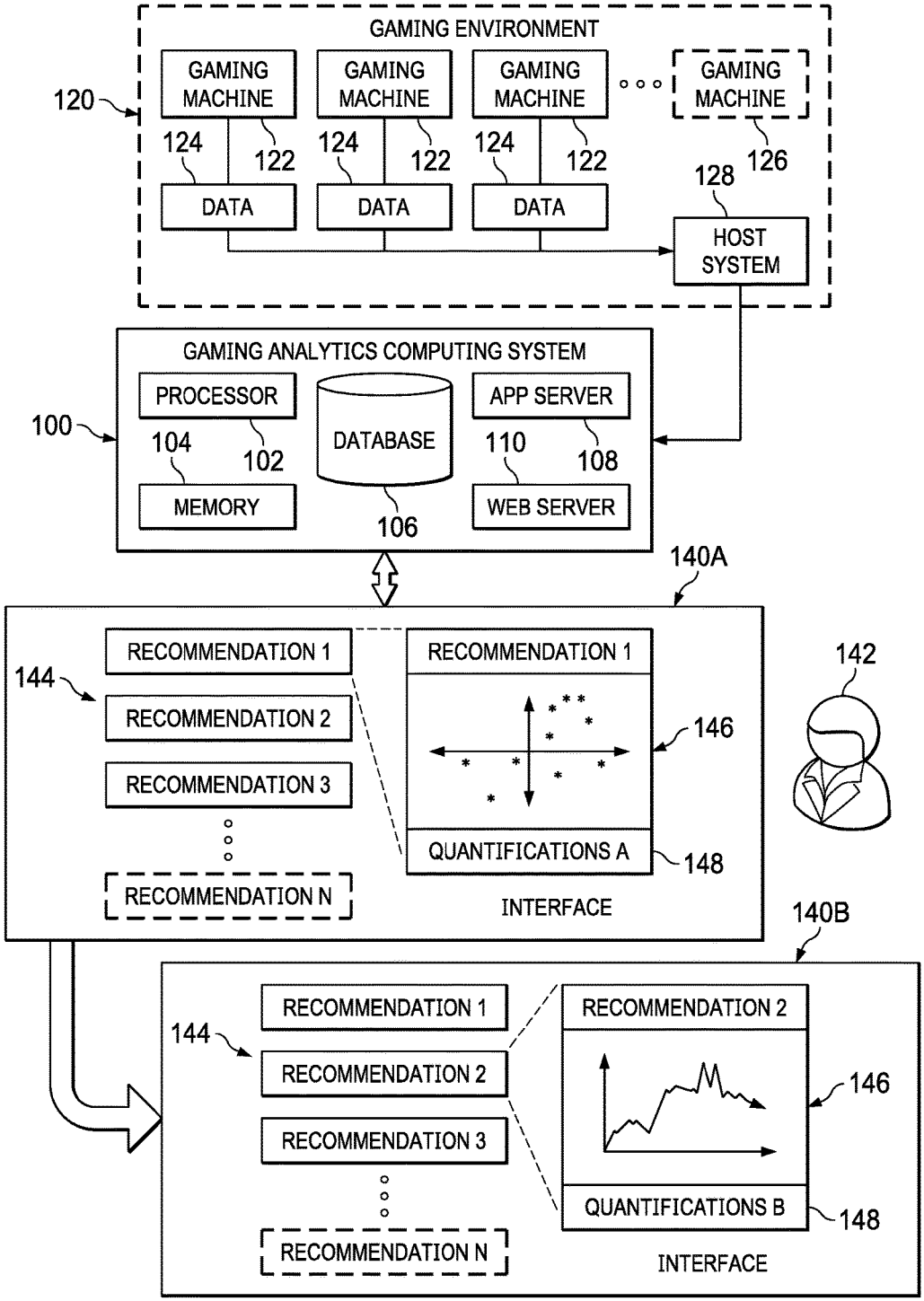
FIG. 1 depicts a gaming analytics computing system in communication with a plurality of gaming machines in accordance with the present disclosure.

Various non-limiting embodiments of the present disclosure will now be described to provide an overall understanding of the principles of the structure, function, and use of a machine-learning driven platform for operational decision making as disclosed herein. One or more examples of these non-limiting embodiments are illustrated in the accompanying drawings. Those of ordinary skill in the art will understand that systems and methods specifically described herein and illustrated in the accompanying drawings are non-limiting embodiments. The features illustrated or described in connection with one non-limiting embodiment may be combined with the features of other non-limiting embodiments. Such modifications and variations are intended to be included within the scope of the present disclosure.

Reference throughout the specification to "various embodiments," "some embodiments," "one embodiment," "some example embodiments," "one example embodiment," or "an embodiment" means that a particular feature, structure, or characteristic described in connection with any embodiment is included in at least one embodiment. Thus, appearances of the phrases "in various embodiments," "in some embodiments," "in one embodiment," "some example embodiments," "one example embodiment, or "in an embodiment" in places throughout the specification are not necessarily all referring to the same embodiment. Furthermore, the particular features, structures or characteristics may be combined in any suitable manner in one or more embodiments.

Throughout this disclosure, references to components or modules generally refer to items that logically can be grouped together to perform a function or group of related functions. Like reference numerals are generally intended to refer to the same or similar components. Components and modules can be implemented in software, hardware, or a combination of software and hardware. The term software is used expansively to include not only executable code, but also data structures, data stores, and computing instructions in any electronic format, firmware, and embedded software. The terms information and data are used expansively and can include a wide variety of electronic information, including but not limited to machine-executable or machine-interpretable instructions; content such as text, video data, and audio data, among others; and various codes or flags. The terms information, data, and content are sometimes used interchangeably when permitted by context.

The examples discussed herein are examples only and are provided to assist in the explanation of the systems and methods described herein. None of the features or components shown in the drawings or discussed below should be taken as mandatory for any specific implementation of any of these systems and methods unless specifically designated as mandatory. For ease of reading and clarity, certain components, modules, or methods may be described solely in connection with a specific figure. Any failure to specifically describe a combination or sub-combination of components should not be understood as an indication that any combination or sub-combination is not possible. Also, for any methods described, regardless of whether the method is described in conjunction with a flow diagram, it should be understood that unless otherwise specified or required by context, any explicit or implicit ordering of steps performed in the execution of a method does not imply that those steps must be performed in the order presented but instead may be performed in a different order or in parallel.

Described herein are example embodiments of computer-based systems and methods that allow casino operators, and other entities in the gaming space, to bring many data sources into an artificial intelligence engine. Once ingested, the data can be analyzed to provide insights and predictive analytics. Based on the predictive analytics operational recommendations can be provided by the system that allows casino operators to improve service to players, drive loyalty, increase profits, and improve cost savings. In accordance with various examples, an intuitive interface that is supported by natural language processing and artificial intelligence is provided to users. Based on the predictive analytics, operational recommendations can be provided to users, such as gaming machine location, gaming machine type, gaming machine denomination, and so forth.

Generally, the present disclosure provides an analytic platform that is intelligent, flexible, and driven by deep learning and machine learning. The platform can be accessed by a natural language query interface. The platform described herein can not only provide full reporting capabilities but also can provide projections, predictions, insights and recommendations designed to best improve operational key performance indicators. Further, information can be presented to users in a way that is natural and timely for users, such as casino operational executives, to understand and act upon.

The analytic platform described herein can predict and utilize any of a variety of metrics, alone or in combination, to provide operational decision making. For example, in accordance with some embodiment, predicted theoretical win, rather than net win, can be used as a target metric for operational decision making. Further, in accordance with the present disclosure, gaming machine performance can be optimized on a machine-by-machine basis. Optimization can include identifying which gaming machine to replace, as well as other operational changes, such as changes to a game, a denomination, or a gaming machine location within a gaming environment. Beneficially, such optimization can be implemented through one or more actionable recommendations provided by the platform, with the recommendations supported by quantifiable data.

As described in more detail below, optimizing floor performance on a factor-by-factor basis (by denomination, manufacturer, etc.) can be predicted in accordance with the present disclosure, thereby generating actionable recommendations with quantified and justified value. In some cases, outside/third-party data sources are utilized to further enhance and inform predictions. Additionally or alternatively, streaming, real-time data can be used to assist in identifying real-time actions which can be taken to optimize short-term performance.

The platform described herein can include a natural language query interface. Associated machine learning algorithms can utilize a database to retrieve appropriate data based on inquiries. In some embodiments, the database is a relational database that can be managed by a database management system. In some embodiments, the database is a graph database, with data stored as nodes and edges. The nodes can represent real-world entities, such as gaming machines, players, game player, and so forth, which contain attributes. Edges of the graph database represent the relationship between nodes. With regard to queries submitted to the platform, the machine learning algorithms can infer the entities about which the query is referring as well as the user's intent behind requesting the query. With these known entities and intent, the can then be queried and traversed until the nodes and edges satisfying the intent with respect to the entities are reached, and the associated data are retrieved.

With the relevant data in hand the platform can utilize machine learning to select the appropriate dynamic visualization scheme and presents the result to the user. Over time, as interactions with the platform increase, it can dynamically learn associations between entities and begins to understand implications of intent and entities to serve not only the requested results, but also related results and offer related questions to fully contextualize the information.

Through strategic choice of visualization methods, data from the platform can be conveyed to a user in visually simplistic techniques, while still delivering full and contextualized information. While much of the information being explored by users through interactions with the platform may be in the form of time series, other data types (e.g., KPI's over disparate time windows) may be better conveyed with other forms of visualizations. As such, the platform can select an optimal visualization type from a set of visualization options. However, just as important as the data in question, are the relationships that exist between different datasets. As such, in accordance with various embodiments, the platform can utilize technology to intelligently identify nearby relationships and quantify their relevance, then categorize them by type and present this information in an intuitive navigation section. The user can then dynamically change between datasets to explore relationships, patterns, correlations, and anomalies.

As is to be appreciated, platforms in accordance with the present disclosure can utilize not only machine-level data such as amount bet, and handle pulls, but also player-level data such as which players are playing which machines and how players move on the floor. Additionally, external data about carded players such as shopping habits, hobby preferences, annual income, estimated discretionary spending budget, external information such as weather, inflation, gas prices, events, concerts, road conditions and so forth, can be used to determine recommendations for floor yield optimization.

Further, the platform described herein can learn user patterns and tendencies, and to understand the structure and composition of data objects. The platform can track behavior as a user navigates throughout the application and utilize machine learning to understand the intent behind the navigation and, in answering future queries, also present the information relevant to the next few questions which are likely to be asked. The platform can present this list of predicted next-questions in the form of button prompts, after applying a filter to ensure sufficient diversity of questions (e.g. so that questions like both "Which machines are winners today?" and "What are my top machines today" are not both presented as possible next questions). The platform can also take the associations learned from the historical navigational sequences and the nature of the questions the user has historically entered to automatically generate insights about the data currently being displayed, to contextualize the information and allow the user a complete multi-dimensional view of their operations. For example, if a user asks "How are my machines doing today?" they may be presented with a scatterplot of machine performance for the day relative to house average, but may also be presented with insights about a disproportionate amount of revenue coming from a certain class of machine.

As described in more detail below, platforms in accordance with the present disclosure can propose recommendations for actions an operations team can take, and quantify the value of these actions. The platform can issue a top-level expected value in terms of expected net win uplift due to the implementation of the recommendation, but also understands there are economic costs to implementing many types of changes. The platform can utilize extensive domain knowledge of the economics of the gaming industry to set default values for calculating the fully loaded cost/value of these recommendations, but also allows users who know specific values their organization can expect for various parameters to override with their own numbers. In doing so the platform can give a fully contextualized quantification of the recommendation as both an estimate of lift to key metrics like net win per unit per day, and a discounted cash flow and income analysis. These processes and considerations are taken into account and executed any time a recommendation or projection is made which would require a change in the fundamental configuration of the gaming floor, including for example the movement or replacement of machines.

In accordance with another aspect of the presently disclosed platform, recommendations can be presented along with a full economic analysis underlying the recommendation. Factors which are not endogenous to the predictions of future performance, for example the amount an organization can be expected to pay for a new machine of a specific type or the organization's weighted cost of capital, are presented as either industry-average defaults or whatever settings the user or organization have configured as a part of their profile. Exogenous variables (those which are not predicted by the model, but rather incorporated as industry defaults or user overrides), like weighted cost of capital, are also adjustable in the justification analysis, which allows a user to easily examine the expected bottom-line value of implementing a recommendation under various hypothetical scenarios. This paradigm can allow a user to exercise judgment and incorporate expectations about future economic conditions to utilize the results of the platform predictions to their full value.

The platform can be used to predict optimal mixes of gaming machines on a gaming floor. Along these lines, the platform disclosed herein can utilize a data driven approach based around the cross-occupancy elasticities of supply (the sensitivity of occupancy rates to changes in supply, or quantity, of machines) to estimate the marginal value of adding or removing arbitrary numbers of machines of arbitrary types. Elasticities can be estimated across the full range of machine quantities which have ever been present on the floor, and historical observations are systematically up- or down-weighted based on similarity of floor conditions (in particular, number of machines of each category) at the time to current conditions. Using these elasticities, an optimal proportion of machines can be arrived at and the marginal value of making the requisite changes quantified. Further, since elasticities are not constant along the supply curve, the platform can intelligently throttle the number of recommendations it presents to a user at any given time to ensure a minimum confidence level is met on the quantified values of each recommendation. Once the recommended changes have been undertaken the model re-calibrates elasticities and re-calculates the optimal proportion, makes new recommendations, and in this way moves the distribution of machines on the floor consistently towards an optimum portfolio.

The platform in accordance with the present disclosure can utilize numerous models built around newly created quantities like game popularity and machine novelty, algorithms for estimating the value of locations on the floor independent of the machines that occupy them, and rigorous statistical normalization at multiple levels. These models can utilize machine learning techniques in accordance with the present disclosure along with deep learning in the form of long short-term memory recurrent neural networks to generate individual predictions of various metric. A machine learning meta-model combines these various predictions to produce a final prediction for each metric. In some uses, the platform can predict and display a 95% confidence window, or other suitable percentage, which allows a user to understand the amount of risk and variance associated with a given prediction.

Neural networks can be used as a component of predicting future machine performance that relies on existing historical data to inform future predictions. For this reason they are not necessarily appropriate for comparing hypothetical machine performances, since no historical data exists for hypothetical machines. Accordingly, the platform in accordance with present disclosure uses a combination of the other machine learning and statistical methodologies to predict an existing machine's performance to generate predictions for both the current machine in a specific location, and for other hypothetical machines and configurations which might be candidates for replacements.

Figure 6:
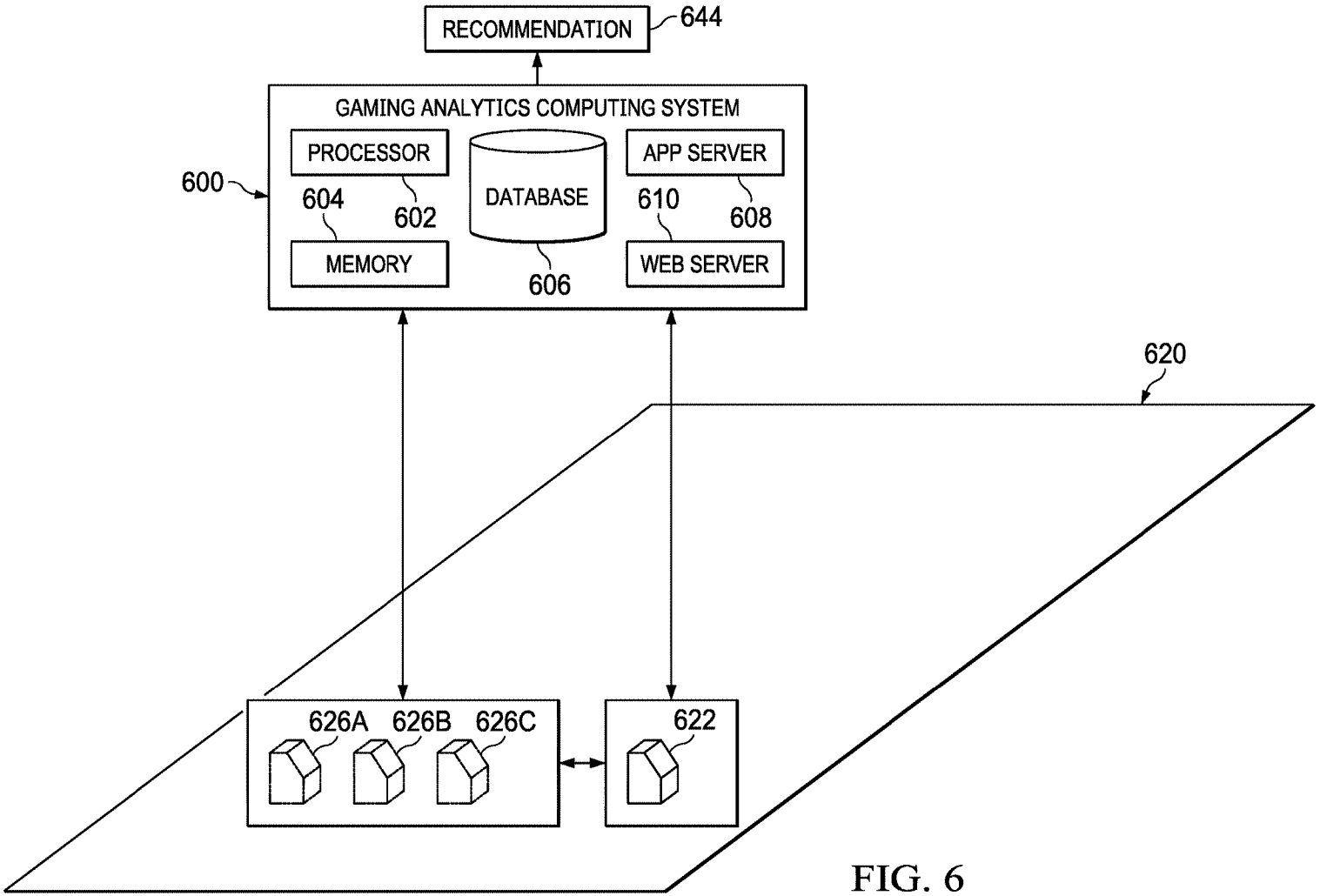

To recommend a machine replacement recommendation or game title change recommendation, the platform can utilize hypothetical machine performance predictions to generate a comparison of the current machine against the new hypothetical machine. For example, the generation of both predicted marginal increase in various metrics and of confidence levels associated with the predictions can be determined, all of which are returned to the user to inform the decision of whether to accept any machine replacement or game title change recommendations. Recommendations can be presented in context of projected change to key metrics, such as net win and amount bet on a daily basis, as well as expected net economic benefit over various future time periods. An example operational use case is schematically shown in FIG. 6 with an example interface shown in FIG. 9.

Moreover, similar to recommending machine replacements, the same algorithms can be utilized to test whether two or more machines should swap locations. The platform can generate predictions for future performance of both machines based on current and swapped locations, and if the economic thresholds for creating a recommendation are met under the hypothetically swapped configuration then the user is notified they should swap machines. An example operational use case is described in more detail below with regard to FIG. 5.

In accordance with various embodiments, the platform can utilize statistical methodologies for identifying outlier machines. Thus, in addition to analyzing data for the purposes of increasing top-line numbers like house net win and amount bet, the platform can utilize statistical and machine learning methods to identify fraud at both the machine and individual player level. In the event fraud is suspected, the platform can push notifications and supporting justifications as determined by the models to the user for further investigation, thus limiting risk to bottom line numbers.

The platform can also be used to predict gaming machine maintenance events and recommend operational actions based on the same. For instance, based on historical failure and servicing of various gaming machine hardware components, the platform can predict future hardware failures or issues. Based on these predictions, the platform can provide operational recommendations, which can include proactively servicing such hardware components in advance of failure. Example gaming machine hardware components can include, without limitation, bill validators, printers, card readers, among other mechanical or electromechanical aspects. Accordingly, by recommending predictive maintenance for gaming machines of a gaming environment, the platform can be used to reduce the likelihood of hardware component failure and the resulting costly operational downtime associated therewith.

The platform can utilize streaming data from the gaming floor to generate real-time information, insights, alerts, and recommendations for optimizing operations. Micro-models can be constructed that run on micro-batches of seconds, minutes, or other smaller periods of time, worth of data, and can constantly project the value of various actions the casino can take along with associated confidence levels. These models also can incorporate economic considerations to give projected fully-loaded values of implementing the recommendations, which together with the associated confidence levels allow the user to make fully informed decisions on whether to accept or reject the recommendation. These models can span the range of recommending promotional recommendations like free play, recommending when to launch games or competitions, among others.

The systems and methods in accordance with the present disclosure beneficially utilize highly granular knowledge of both machine parameters and machine performance. In some cases, with an understanding of each possible permutation of game combination available on the machine and wager size, and for each permutation, the long-run standard deviation of a game can be determined. Such determination can either be through a Volatility Index (VI) as provided on a par sheet, through an associated paytable which includes probabilities and payouts for each possible outcome, or other methods. Machine performance data, as outlined below, can be collected and segmented by each combination of game title and wager size. Each unique combination of game title and wager size is referred to herein as a "game combination."

With respect to machine measurements, below is example gaming machine data that can be utilized by the platform:

- Machine ID (unique)
- Game Combo
  - Manufacturer
  - Game Title
  - Denomination (i.e., Wager Size)
  - Long-Run Standard Deviation
  - Fees or Royalties, Associated Percentages, and Accounting Methods
    - In-House/Proprietary Progressive
    - Wide Area Progressive
    - Royalty
    - None
- Duration of Measurement Window
- Timestamp
  - Year, Month, Day, and any additional granularity available
  - Which point in the measurement window the timestamp corresponds to (beginning, end, etc.)
- Coin-in
- Coin-out
- Drop
- Jackpots paid out
- Hopper Fills
- Location/Placement Information, such as:
  - Area ID
  - Bank ID
  - Bank Shape
    - Rectangle
    - Linear
    - Arc
    - Tri-Pod
    - Round/Carousel
  - Location/Position ID
  - Seat Type
    - Middle Seat
    - End Seat
    - End Cap
    - Round For the above metrics, and other quantities to follow, the terms are naturally extended to pertain exclusively to certain classes of play, where explicitly stated. For example, should a user be interested in the dynamics of a Player's Club or the performance of a marketing promotion, certain quantities like Coin In could be exclusively restricted to wagers placed by members in the Player's Club, or wagers which were funded with promotional dollars.

The systems and methods in accordance with the present disclosure can utilize one or of the following metrics in the decisioning described herein.

Actual Win: Coin In—[Coin Out+Jackpots Paid Out]

Meter Win: Drop—[Hopper Fills+Jackpots Paid Out]

Hold Percentage: Meter Win/Coin In

Actual Win Percentage: Actual Win/Coin In

Meter Win Percentage: Meter Win/Coin In

Handle Pulls: Coin In/Wager Size

Average Wager: For a fixed time window and specific machine with wager sizes $w_i$, if that machine has $h_i$ many handle pulls within that time window for each wager size then the average wager is defined as the quantity:

$$\text{Average Wager} = \frac{\sum_i w_i \cdot h_i}{\sum_i h_i} \quad \text{EQ. 1}$$

Expected Payout: For a game combination with potential payouts $w_i$ and associated probabilities $p_i$, the Expected Payout is defined as the quantity:

$$\text{Expected Payout} = \sum_i w_i p_i \quad \text{EQ. 2}$$

Return to Player (RTP): Expected Payout/Wager Size

Par Percentage: 1—Return to Player

Theoretical Win: Par Percentage×Coin In

Machine Day: Operation of a machine at a fixed location for 24 continuous hours, or 1 full business day.

Occupancy: For each game combination i on a particular machine, assume an estimate of the number of handle pulls per minute $e_i$ when that specific game combination is being continuously played known. When the true number of handle pulls $h_i$ within a specific time window of length T minutes is known, then the occupancy of the machine over that time window can be defined to be the quantity:

$$\text{Occupancy} = \frac{1}{T}\sum_i \frac{h_i}{e_i} \quad \text{EQ. 3}$$

(Actual, Theoretical, Meter) Take-Home (Par, Win, Percentage): For machines with royalties or fees, Take-Home variants on metrics can be defined to be those metrics, minus any royalties or fees paid, and for machines without royalties or fees the metrics are equivalent. For example, if royalties are 5% of Coin-In, Coin-In for the day was $8,000, and Par Percentage is 9%, then Theoretical Take-Home Win for the day would be $8,000·(9%−5%)=$320.

Utilizing the framework described herein, the value of a change in the mix of machine types based on expected total theoretical net win as calculated utilizing estimated supply elasticities of occupancy can be determined utilizing a supply-driven machine mix optimization model. The model can operate under assumptions that theoretical net win is stable in time, and dependent only on the type of machine in question. As such, the data relative to factors such as location and seat type which do not directly relate to the type categories as the user chooses to define them can be normalized. Time variables utilized in the model can be assumed to be relative to current time; e.g. when units are days, t=6 corresponds to 4 days before the present.

Supply Elasticity of Occupancy can be estimated in accordance with the following methodologies. For a particular gaming environment, the machines can be partitioned in n types. For a given change from supply $S_1$ to $S_2$ of machines of a particular type (i.e., type j) at a particular point in time t units ago, and induced change in mean occupancy rates from $O_1$ to $O_2$, the supply elasticity of occupancy observed at time t to be the quantity can be defined as:

$$E_{j,t} = \frac{\frac{S_1 + S_2}{2}}{\frac{O_1 + O_2}{2}} \times \frac{O_2 - O_1}{S_2 - S_1} \quad \text{EQ. 4}$$

This is best understood as the mean of percentage change in occupancy divided by percent change in supply, where the mean is taken over both directional movements (i.e, on the supply side, both $S_1 \rightarrow S_2$ and $O_1 \rightarrow O_2$, and vice versa $S_2 \rightarrow S_1$ and $O_2 \rightarrow O_1$).

In accordance with the present disclosure, a methodology for estimating the supply elasticity of occupancy for a particular machine type based on historical data can be established. To do so, considerations to the time windows can be restricted to be around when machines of a particular type were added or removed from the casino floor; let $S_{1,i}$ be the number of machines of type j available for play before the change at time $t_i$, and $S_{2,i}$ the number of machines available after the change.

An exponential weighting methodology can be used to derive an estimate of the current elasticity for machines of type j, relative to the supply $S_0$ of machine type j available today:

$$\hat{E}_j = \frac{\alpha + \sum_i E_{j,t_i} e^{-\beta t_i - \gamma\left(\left|\frac{\frac{S_{1,i}+S_{2,i}}{2} - S_0}{S_0}\right|\right)}}{\delta + \sum_i e^{-\beta t_i - \gamma\left(\left|\frac{\frac{S_{1,i}+S_{2,i}}{2} - S_0}{S_0}\right|\right)}} \quad \text{EQ. 5}$$

where the hyperparameters α, β, γ, and δ can be optimized with any number of machine learning and/or grid-search type techniques.

In some cases, α and δ

$$\left(\text{or their ratio } \frac{\alpha}{\delta}\right)$$

can be set equal across all types, or impose restrictions on the variability of their proportion from an average or median, since the ratio $$\frac{\alpha}{\delta}$$

is incorporated as a smoothing factor to supplement scenarios in which amount of available observations for a specific type is low, the data exhibit high variance, or other such cases when the historical elasticities do not provide highly reliable estimates.

In accordance with the present disclosure, cross supply elasticities of occupancy can be estimated. Supply elasticity of occupancy is useful in estimating the marginal impact of adding or removing machines of a specific type, if the universe consisted exclusively of machines of that type. However it fails to account for the high degree of substitutability between machine types for most players. As such, cross-supply elasticities of demand can be utilized to capture these effects.

The cross supply elasticity of occupancy of machine type j relative to k at time t when the supply of machine type j is changed is defined similarly to the supply elasticity of occupancy observed at time t, describe above. With regard to determining ross supply elasticity of occupancy of machine type j relative to k at time t, the pre- and post-change supply quantities $S_{1,i,j}$ and $S_{2,i,j}$ are relative to machine type j, while the pre- and post-change mean occupancy rates $O_{1,i,k}$ and $O_{2,i,k}$ are relative to machine type k:

$$E_{j,k,t_i} = \frac{\frac{S_{1,i,j} + S_{2,i,j}}{2}}{\frac{O_{1,i,k} + O_{2,i,k}}{2}} \times \frac{O_{2,i,k} - O_{1,i,k}}{S_{2,i,j} - S_{1,i,j}} \quad \text{EQ. 6}$$

This equation can be used in conjunction with an exponential down-weighting methodology across both time and supply similarity to develop an estimate for current cross price elasticity of demand for each pair j, k of machine types. For each pair of machine types j, k considerations can be restricted exclusively to those points in time $t_i$ in which a change was made to the total supply of machine type j and estimate the true cross price elasticity of occupancy of machine type j relative to k at the current time to be the quantity:

$$\hat{E}_{j,k} = \frac{\alpha + \sum_i E_{j,k,t_i} e^{-\beta t_i - \gamma\left(\left|\frac{\frac{S_{1,i,j}+S_{2,i,j}}{2} - S_{0,j}}{S_{0,j}}\right|\right)}}{\delta + \sum_i e^{-\beta t_i - \gamma\left(\left|\frac{\frac{S_{1,i,j}+S_{2,i,j}}{2} - S_{0,j}}{S_{0,j}}\right|\right)}} \quad \text{EQ. 7}$$

where $S_{0,j}$ represents the current supply of machine type j. It is noted that this equation can be sufficient for calculating both supply elasticities and cross-supply elasticities, as this EQ. 7 reduces to EQ. 5 when j=k, so EQ. 7 can be sufficient for calculating both supply elasticities and cross-supply elasticities.

In accordance with the present disclosure, the total (house) theoretical Net win can be estimated. First, the theoretical net win for all machines of type k when we increase the supply of machine type j from $S_{1,j}$ to $S_{2,j}$ is calculated. With a mean occupancy rate of machine type k of $O_{1,k}$, a mean number of handle pulls per minute of $H_k$, a mean wager size of $B_k$, and a number of machines $N_k$ of type k, the expected theoretical net win of machines of type k can be estimated as $$\hat{W}_k = H_k B_k N_k O_k \left(1 + \hat{E}_{j,k}\left(\frac{S_{2,j}}{S_{1,j}} - 1\right)\right) \quad \text{EQ. 8}$$

Assuming now a user intends to make simultaneous changes to supply quantities of multiple different types of machines. Let $S_{1,j}$ and $S_{2,j}$ be the quantities of machine type j before and after the change, and note that each change will have a marginal impact on the occupancy rate of machine type k of $$E_{j,k}\left(\frac{S_{2,j}}{S_{1,j}}\right).$$

Adding up these marginal changes to the base occupancy rate, the theoretical net win $W_k$ is estimated as:

$$\hat{W}_k = H_k B_k N_k O_k \left(1 + \sum_j \hat{E}_{j,k}\left(\frac{S_{2,j}}{S_{1,j}} - 1\right)\right) \quad \text{EQ. 9}$$

For a given collection of changes in supply of machine types i from quantities $S_{1,i}$ to $S_{2,i}$ the estimate of the expected total (house) theoretical net win W is:

$$\hat{W}_k = \sum_k H_k B_k N_k O_k \left(1 + \sum_j \hat{E}_{j,k}\left(\frac{S_{2,j}}{S_{1,j}} - 1\right)\right) \quad \text{EQ. 10}$$

In view of the model of total win based on a number of quantified changes in machine types, it is possible to maximize this equation to determine the theoretically optimal mix of machines. However, this is very delicate process because of the nature of elasticities and their tendency to change as one moves along the supply/occupancy curve. In the event the model recommends a mix of machines which is highly different from the existing mix, a slow but consistent implementation process and frequent re-calculation of elasticities would be a strong validation step to ensure the proper changes are being recommended. As such, the systems and methods described herein can provide through the interface answers to operational questions such as "Which machine type should I incrementally increase or decrease?", or "Which machine type should I replace with which machine type?" Beneficially, these kind of incrementally-minded questions can be well-addressed by the platform described herein, and longer-term or wholesale changes can be systematically achieved and validated through such repeated incremental changes.

In some embodiments, an alternate formula for elasticities is utilized. Namely, EQ. 4 and 7 can be used to calculate elasticities incorporate a scaling factor:

$$\frac{\left|\frac{S_{1,i} + S_{2,i}}{2} - S_0\right|}{S_0} \quad \text{EQ. 11}$$

This scaling factor can exponentially down-weight historical elasticities which were observed under supply quantities which were significantly different from the supply $S_0$ available today. This is because elasticities are not constant along most supply/occupancy curves, and the modeling seeks to allow changes which occurred under similar supply conditions to most greatly influence the estimates.

While this factor scales the absolute difference to a proportion of the existing amount, but depending on performance the absolute (unsealed) difference may be used in place:

$$\left|\frac{S_{1,i} + S_{2,i}}{2} - S_0\right| \quad \text{EQ. 12}$$

As with many aspects of the model, this choice can be dependent on the user could potentially vary depending on a number of factors, including the casino and the choice of class types.

In accordance with the present disclosure, the platform described herein can recommend replacement machines for specific floor locations. More specifically, the platform can take a specific floor layout and a specified machine within that layout and recommend an optimal machine to replace the specified machine. Such determination can be based on expected theoretical win, with the platform producing an estimate of that expected theoretical win.

First, the expected value model is learned in accordance with one non-limiting embodiment by normalizing the data for yearly, monthly, and weekly seasonal trends. Next, normalized data is regressed onto seat type dummy variable and normalized for effect. The floor distribution is then constructed and residuals are normalized for effect. For each type of non-substitutable play, the appetite is estimated and value from machines of that type is subtracted off proportional to respective location values under the floor distribution. Next, the game novelty curve is constructed and residuals are normalized for effect. The overall game novelty curve is then identified and for each game type, a sensitivity to game novelty effect is calculated. Covariance with nearby games for each pair of game types is calculated and normalized for effect. A regression on the residuals is performed to determine popularity of game type and normalized for effect. For the specified location, an expected value for each possible game type according to the model is calculated. Finally, the platform recommends a game type with the highest expected value.

In accordance with some embodiments, time-series techniques can be utilized to de-seasonalize the data across yearly, monthly, and weekly timescales. This approach can normalize the data so that theoretical wins can be compared across different times. Once seasonality has been normalized for, a linear regression can be ran on the dummified Seat Type variable on the resulting normalized data thereby allowing a comparison of machine performance across different seat types.

At this point the model is as follows, with t subscript indicating a time series quantity applied pointwise in time:

$$Y = \text{Seasonality Adjustment}_t \times \text{Seat Type} + \text{Residual} \quad \text{EQ. 13}$$

Having controlled for both seasonality and seat type effects, a floor distribution can be created that represents the value of placing a machine at a particular location, regardless of when and of what seat type. Any of a multiple methodologies can be utilized, depending on whether or not pairwise distances between machines are available or if the model is relying merely on bank/zone/area data.

First, a radial basis function K(x, y) is selected, which is any real-valued function satisfying K(a, b)=K(c, d) whenever |a−b|=|c−d|], such as the Gaussian radial basis function. For a specific location $x_0$ and time window t, let $g(x_0, t)$ be the game title at location $x_0$ during time window t and fix another game title G. Let $A_t(h)$ be the function which yields the average theoretical win of game title h during time window t across all machines playing game title h during time t, and T be the sum total number of time units for which we have data on games positioned at location $x_0$. If $w(x_0, t)$ is the theoretical win of the machine at location $x_0$ during time window t, then the floor distribution $F(x_0)$ of the value of floor location $x_0$ is $$F(x_0) = \frac{1}{T}\left(\sum_{Locations\ x_i}\left(K(|x_i - x_0|)\sum_t\left(\omega(x_0, t)\frac{A_t(g(x_i, t))}{A_t(g(x_0, t))}\right)\right)\right) \quad \text{EQ. 14}$$

As a result, the model is now:

$$Y = \text{Seasonality Adjustment}_t \times (\text{Seat Type} + \text{Floor Value} + \text{Residual}) \quad \text{EQ. 15}$$

In accordance with the present disclosure, the next step utilizes estimates of the non-substitutable play for each game type. In particular, non-substitutable play is defined to be the amount of coin-in which will be wagered regardless of arrangement or availability on a well-defined subset of machines. Such estimates can be provided, for instance, by marketing and/or operations teams. One example of non-substitutable play would be those players which exclusively play penny slots. Further, in accordance with some embodiments, non-substitutable play is assumed to be relatively fixed for each game type, and if any additional money were to be wagered by players it would be substitutable. This approach implies non-substitutable play is not impacted by the introduction of a new or different type of machine, and should therefore be removed from consideration. It is noted that it is removed this late in the process in order to remove it proportional to the rate at which machines of any particular type are played, so as to account for differences in rates of play based on floor location (i.e, not debit low-traffic/low-win machines equally with high-traffic/high-win machines).

Assuming the total non-substitutable play by type has been quantified, it can be multiplied by an average/weighted average of par percentage for machines providing that play type, and the resulting amount divided among each machine providing that play type proportional to its locational value when evaluated under the floor distribution.

As an example, suppose an organization estimates they have $5M in non-substitutable penny-slot play per month on average, and 100 machines which allow penny-slot play. The next step would be to evaluate the floor distribution at each of those 100 locations, say with results {1.4, 0.8, 0.7, 1.1, . . . }, totaling to 89.2. Say the mean par percentage is estimated at 9%, then the final step would be to subtract the $5M×0.09=$450k among each of the 100 machines proportionally; that is, subtract $450k×1.4/89.2≈$7k from machine 1, subtract $450k×0.8/89.2≈$4k, and so on.

If non-substitutable play has experienced significant swings or changes over time, the formulation of the non-substitutable play can be considered a time series with yearly estimates, and subtracted as a time series from the corresponding years of historical data.

As such, the model is now:

$$Y = \text{Seasonality } Adjustment_t \times (\text{Seat Type} + \text{Floor Value} + \text{Non-substitutable Play} + \text{Residual}) \quad \text{EQ. 16}$$

In accordance with some embodiments of the present disclosure, it is assumed that game novelty begins adding value initially rather rapidly, then over time begins to fall to zero. This behavior is modeled well with a third-order polynomial. Further, it can be assumed the value-add of novelty is unique to a game title. For each game title the residuals for machines playing that game title are centered on "day 1", which is the first day each was available for play on the floor. For each successive day for the following 6 months the mean of the residuals is computed for games of that type. The mean of all residuals over the entire 6 months is then subtracted off from this time series, to center the series on 0.

A third order polynomial $p_3(t)=\beta_0 t+\beta_1 t^2+\beta_2 t^3$ can then be to the centered time series, which can be accomplished via a number of existing mathematical computing libraries. The title-specific novelty factor can be added to the model, to obtain the following model:

$$Y = \text{Seasonality } Adjustment_t \times (\text{Seat Type} + \text{Floor Value} + \text{Non-substitutable Play} + Novelty_t + \text{Residual}) \quad \text{EQ. 17}$$

In accordance with the present disclosure, complimentary effects with nearby games can be accounted for in the model. As the methods described herein are data-driven, there may be circumstances in which a sufficient quantity and variety of data to perform robust analysis is not present. In such situations, the complimentary Effects term may be omitted from the subsequent model equations.

To perform analysis in according with the present disclosure, the analysis can be restricted to those moments in time during which an old machine was swapped out for a new one. In particular, for a specific game title under examination, the model can be restricted to analyze the scenarios in which either a machine in the bank, or the newly swapped in machine is playing the game title in question. For each game title, the analysis can be further restricted to the situations in which one of the bank machines and the newly swapped in machine is playing the game title in question, and the other game title under consideration (which could potentially be the same). The average ratio increase in theoretical net win can be computed across both machines for the two months following the swap as compared to the two months preceding the swap. This ratio is compared to the same ratio when computed for all newly-swapped-in machines relative to all other machines in the same bank. While this embodiment utilizes a 2 month window, it is to be appreciated that other suitable periods of time can be used.

This ratio is then multiplied by the preceding model to obtain a model equation which accounts for complimentary effects of nearby games:

$$Y = \text{Seasonality } Adjustment_t \times ((\text{Seat Type} + \text{Floor Value} + \text{Non-substitutable Play} + Novelty_t) \times \text{Complimentary Effects} + \text{Residual}) \quad \text{EQ. 18}$$

Finally, the residuals of the preceding model can be regressed against dummy variables corresponding to game type attributes to determine the popularity of various games. These attributes may include, for example, game title, manufacturer, and so forth. This results in a final model:

$$Y = \text{Seasonality } Adjustment_t \times ((\text{Seat Type} + \text{Floor Value} + \text{Non-substitutable Play} + Novelty_t) \times \text{Complimentary Effects} + \text{Popularity} + \text{Error}) \quad \text{EQ. 19}$$

After training the above model, the model can be evaluated for the specific location in question for each potential game title. This evaluation will yield an expected value for each potential game title. The platform can then identify the machine that should be introduced to the location. More specifically, it can recommend the game title with the highest of these expected values.

In accordance with the present disclosure, change point detection can be used to identify machines which have changed earning behavior. More specifically, utilizing the frameworks and conventions described herein, change point detection can be utilized to identify machines which have experienced downturns in performance as determined by theoretical net win. Change points within time series are considered to be points in which the process generating the time series has undergone a meaningful structural change, and are particularly interested in identifying those change points which result in a change in the underlying linear trend governing the time series.

The identified change points can be utilized to model machine performance in a piecewise linear fashion, which in turn allows users to make decisions about which machines' earning behaviors have changed sufficiently to warrant replacement. In accordance with some embodiments, machines are considered which have been on the floor in the same stand continuously for at least $n \geq 30$ machine days. The possibility of change points can be examined, for example, in the last min $$\left(90, \frac{2n}{3}\right)$$

machine days, but at least max $$\left(15, \frac{n}{3}\right)$$

machine days ago.

Example methodologies for change point detection can be found in Achim Zeileis et. al. *strucchange: An R Package for Testing for Structural Change in Linear Regression Models*, Available: https://cran.r-project.org/web/packages/strucchange/vignettes/strucchange-intro.pdf; D. W. K. Andrews. *Tests for parameter instability and structural change with unknown change point*. Econometrica, 61:821-856, 1993; D. W. K. Andrews and W. Ploberger. *Optimal tests when a nuisance parameter is present only under the alternative*. Econometrica, 62:1383-1414, 1994. R. L. Brown, J. Durbin, and J. M. Evans. *Techniques for testing the constancy of regression relationships over time*. Journal of the Royal Statistical Society B, 37:149-163, 1975; G. C. Chow. Tests of equality between sets of coefficients in two linear regressions. Econometrica, 28:591-605, 1960, each of which are incorporated herein by reference in their entirety.

In accordance with the present disclosure, a significance threshold $\alpha$ is set to an appropriate value, such as $\alpha=0.025=2.5\%$. For each machine which has been on the floor for over a month, the Fstats function within the strucchange package can be utilized to compute a new time series $p_t$ of p-values from the time series of the machine's theoretical net win testing the null hypothesis that no structural change has occurred to the alternate hypothesis that a structural change occurred at time t, for each possible change point t within the min $$\left(90, \frac{2n}{3}\right)$$

machine days but at least max $$\left(15, \frac{n}{3}\right)$$

machine days ago.

Once we the series of p-values $p_t$ is determined, $p_t$ is transformed into a 3-day moving average $\bar{p}_t$ to smooth the time series and identify the points $c_i$ for which $\bar{p}_{t_i}<\alpha$. If $i>1$, only the points $C=\{C_i\}$ identified by the following algorithm are kept in an effort to ensure multiple change points are not retained which in fact all represent the same underlying change:

1. $\tau=0$
2. Set $C_\tau=\min_{c_i}\bar{p}_{c_i}$ the time $c_i$ corresponding to the minimum achieved by $\bar{p}_t$
3. Until no $C_{\tau+1}$ can be found satisfying the following,
   1. Set $C_{\tau+1}$ equal to the time $c_j$ corresponding to the minimum value achieved by $\bar{p}_t$ over the remaining $c_i$ not already in C, which also satisfy the condition that $\bar{p}_{t_k}, \bar{p}_{t_l}>\alpha$ for some $k\in(t_\phi, t_{c_j})$ and $l\in(t_{c_j}, t_\theta)$ where $\phi$ is the maximum in C less than $c_j$ and $\theta$ is the minimum in C greater than $c_j$. This ensures that the significance peak (significance being calculated as 1−p value) achieved at $C_{\tau+1}$ is "prominent" above the threshold significance; in particular, it ensures the significance of $\bar{p}_t$ falls below the significance level on either side of $C_{\tau+1}$ before it rises above the threshold again at $C_{t_\phi}$ and $C_{t_\theta}$ below and above $c_j$, respectively.
   2. Increment $\tau$ (i.e, set $\tau=\tau+1$)

The retained points $C=\{C_i\}$ are the identified change points.

Next, using the identified change points, machine performance can be modeled. More specifically, historical machine performance can be modeled by piecewise linear regression, with break points at the identified change points. This constitutes simple linear regression on the time windows between each change point, and can be accomplished with a number of scientific computing packages.

A choice can be made whether to assume the underlying function is piecewise continuous, which would place significant restrictions on the regression results but would model the scenario in which effects which induce change points do not manifest as immediate jumps in theoretical net win, but rather gradual accelerations following a linear trend.

In accordance with systems and method described herein, machines for which performance as measured by theoretical net win is statistically significantly deviating from the specified parameters of their supported game combos can be identified. Such machines can be inspected for any source of mis-performance, such as physical malfunction, fraud, and so forth.

In accordance with the present disclosure, a distribution of a game combination can be developed. First, starting with a single game combination on a single machine, the limiting distribution governing actual win for a specific time window can be determined, given the number of handle pulls, par percentage and long-run standard deviation of the game combination. Next, the same is determined for a multi-denomination/multi-game machine, and an associated p-value is calculated to determine the extremity of the results. A correction can then be introduced to accommodate comparisons of multiple machines for the purposes of outlier detection.

By way of example, suppose that, within a fixed time window T, this is a number of handle pulls h, theoretical win per handle pull $\pi$ (equal to par percentage times wager), and long-run standard deviation s. Since consecutive handle pulls are i.i.d, from the Central Limit Theorem the mean win per handle pull over h handle pulls is known to follow a normal distribution with mean $\pi$ and standard deviation $$\frac{s}{\sqrt{h}}.$$

That is, for large h, the approximate distribution is:

$$\frac{\omega}{h} \sim N\left(\pi, \frac{s^2}{h}\right) \quad \text{EQ. 20}$$

where $\omega$ is the distribution of actual win over the time period T. Through basic properties of i.i.d.

normal random variables, it can be seen that:

$$\frac{\omega}{h} \sim N(h\pi, s^2) \quad \text{EQ. 21}$$

Based on the above, the distribution of a machine can be developed. Extrapolating the above across multiple game combinations, a specific game combination may have wins $w_i$, theoretical wins per handle pull $\pi_i$, long-run standard deviations $s_i$, and handle pull counts $h_i$. Then actual win w is given by $w=\Sigma_i w_i$, and, after applying more basic properties of normal distributions, that the limiting distribution is given by:

$$\omega = \sum_i \omega_i \sim \sum_i N(h_i\pi_i, s_i^2) = N\left(\sum_i h_i\pi_i, \sum_i s_i^2\right) \quad \text{EQ. 22}$$

Now that the limiting distribution of actual win w is known, with the guiding assumption each $h_i$ is either comparatively large (>25-30) or zero a p-value can be computed for the observed actual win W. To do this, W is normalized by the parameters of the limiting distribution w to obtain a z-statistic, and the area under the standard normal distribution beyond this point is computed. In particular the z-statistic is given by:

$$z = \frac{W - \sum_i h_i\pi_i}{\sqrt{\sum_i s_i^2}} \quad \text{EQ. 23}$$

The associated p value can be computed with a suitable statistical package or reference table.

Next, in accordance with the present disclosure, individual machines from among a population (say, of size n) which are not performing according to their statistical specifications can be identified. To combat the problems inherent when making multiple comparisons, two example options, both of which require selecting a confidence level $\alpha$ before performing any calculations, are described here. The first option is to employ the Bonferroni correction, and test p values at the significance level of $$\frac{\alpha}{n};$$

any machines which have p-values falling below this threshold should be inspected for irregularities. The second option is to use a modification of the Bonferroni correction which attempts to accommodate the potential for different rates of play among different machines. By way of example, suppose machine j has had $H_j$ number of handle pulls. The p-values can then be computed and any machines with p-values falling below $$\frac{H_j\alpha}{\sum_j H_j}$$

can be inspected.

Referring to FIG. 1, an embodiment of gaming analytics computing system 100 is depicted. The gaming analytics computing system 100 can be used by a user 142, such as a casino operations executive or other type of user. Using the data analytics and modeling techniques described above, the gaming analytics computing system 100 can be used to provide the user 132 with specific, quantified operational recommendations, as described in more detail below.

The gaming analytics computing system 100 can receive data 124 generated from one or more gaming machines 122 associated with a gaming environment 120. The data 124 from the gaming machines 122 can be supplied to the gaming analytics computing system 100 through one or more intermediaries, such as host system 128. The host system 128 can include, for example, a slot management system, a casino management system, and/or other data aggregator systems. In some implementations, the data 124 can be supplied directly to the gaming analytics computing system 100 some or all of the gaming machines 122. The gaming machines 122 can each be, without limitation, any type of gaming machine, such as a video slot machine, a poker machine, a reel slot machines, a multi-game unit, among other types of electronic gaming machines know in the art. While only three gaming machines 122 are shown in FIG. 1 for illustration purposes, it is to be appreciated that the gaming analytics computing system 100 can be configured to receive data from hundreds or even thousands of different gaming machines associated with a gaming environment 120, as represented by gaming machine 126. Furthermore, it is to be appreciated that the gaming environment 120 can be any suitable environment, such as a casino gaming floor, or multiple gaming floors across a plurality of different properties. The data 124 utilized by the gaming analytics computing system 100 can include, without limitation, streaming data (i.e., gameplay related data), non-changing data (i.e., manufacturer), and/or updatable data (i.e., location, seat type). By way of example, the data 124 can include any of the following information: unique machine ID, game combination, duration of measurement window, time stamp, coin-in, coin-out, drop, jackpots paid out, hopper fills, and location/placement information.

The gaming analytics computing system 100 can be in communication with the host system 128 via an electronic communications network. The communications network can include a number of computer and/or data networks, including the Internet, LANs, WANs, GPRS networks, etc., and can comprise wired and/or wireless communication links. In addition to the host system 128, the gaming analytics computing system 100 can be in networked communication with other devices, such as other computing devices associated with the gaming environment 120 or other third party sources of data. Additionally, other sources of data can be supplied to the gaming analytics computing system 100 through appropriate data transmission or transfer techniques, such as flat files and so forth. By way of example, in some embodiments, the gaming analytics computing system 100 can receive player loyalty data, player spend data, or other player-specific demographics.

The gaming analytics computing system 100 can be provided using any suitable processor-based device or system, such as a personal computer, laptop, server, mainframe, or a collection (e.g., network) of multiple computers, for example. The gaming analytics computing system 100 can include one or more processors 102 and one or more computer memory units 104. For convenience, only one processor 102 and only one memory unit 104 are shown in FIG. 1. The processor 102 can execute software instructions stored on the memory unit 104. The processor 102 can be implemented as an integrated circuit (IC) having one or multiple cores. The memory unit 116 can include volatile and/or non-volatile memory units. Volatile memory units can include random access memory (RAM), for example. Non-volatile memory units can include read only memory (ROM), for example, as well as mechanical non-volatile memory systems, such as, for example, a hard disk drive, an optical disk drive, etc. The RAM and/or ROM memory units can be implemented as discrete memory ICs, for example.

The memory unit 104 can store executable software and data for the analytics platform described herein. When the processor 102 of the gaming analytics computing system 100 executes the software, the processor 102 can be caused to perform the various operations of the gaming analytics computing system 100, such as optimizing machine performance, optimize floor performance, and provide a query-driven user interface 142.

Data used by gaming analytics computing system 100 can be from various sources, such as a database(s) 106, which can be electronic computer databases, for example. In some embodiments, the database 106 comprises a graph database utilizing graph structures for semantic queries with nodes, edges and properties to represent and store data. Additional details regarding example operational use of a graph database are provided below with reference to FIGS. 4A-4B. The data stored in the database(s) 106 can be stored in a non-volatile computer memory, such as a hard disk drive, a read only memory (e.g., a ROM IC), or other types of non-volatile memory. In some embodiments, one or more databases 106 can be stored on a remote electronic computer system, for example. As it to be appreciated, a variety of other databases, or other types of memory storage structures, can be utilized or otherwise associated with the gaming analytics computing system 100.

The gaming analytics computing system 100 can include one or more computer servers, which can include one or more web servers, one or more application servers, and/or one or more other types of servers. For convenience, only one web server 110 and one application server 108 are depicted in FIG. 1, although one having ordinary skill in the art would appreciate that the disclosure is not so limited. The servers 108, 110 can allow content to be sent or received in any of a number of formats, which can include, but are not limited to, text-based messages, multimedia messages, email messages, smart phone notifications, web pages, and other message formats. The servers 108, 110 can be comprised of processors (e.g. CPUs), memory units (e.g. RAM, ROM), non-volatile storage systems (e.g. hard disk drive systems), and other elements.

In some embodiments, the web server 110 can provide a graphical web user interface, such as the interface 140A, through which various users 142 can interact with the gaming analytics computing system 100. The graphical web user interface can also be referred to as a client portal, client interface, graphical client interface, and so forth. The web server 110 can accept requests, such as HTTP/HTTPS requests, from various entities, such as HTTP/HTTPS responses, along with optional data content, such as web pages (e.g. HTML documents) and linked objects (such as images, video, and so forth). The application server 108 can provide a user interface, such as the interface 140A, for users who do not communicate with the gaming analytics computing system 100 using a web browser. Such users can have special software installed on their computing devices to allow the user to communicate with the application server 108 via a communication network.

A user 142 can be presented with the interface 140A, as generated by the gaming analytics computing system 100. A user 142 can utilize, for example, a mobile phone, a smartphone, a tablet, a laptop, a desktop, a kiosk, or other computing device capable of displaying the interface 140A. In accordance with modeling described above, the interface 140A can identify one or more recommendations 144 based on the data analytics described above. The recommendation 144 can be supported by a data visualization 146. The particular format of the data visualization 146 can be chosen by the gaming analytics computing system 100 based on, for example, the underlying data and the type of query submitted by the user 142.

Furthermore, in some embodiments, quantifications 148 can also be presented to the user 142, with the quantifications 148 providing justifications for the associated recommendation. In some embodiments, the gaming analytics computing system 100 can utilize domain knowledge of the economics of the gaming industry to set default values for calculating the fully loaded cost/value of the recommendations 144, among other types of quantified metrics. Additionally, in some implementations, a user 142 can provide specific values their organization thereby allowing various parameters to override default values. As a result, the gaming analytics computing system 100 can provide, via the interface 140A, a fully contextualized quantification 148 of the recommendation 144. As schematically depicted in FIG. 1, interface 140B shows that the data visualization 146 can change when a different recommendation and different quantifications are presented to the user 142 (shown as recommendation 2 and quantifications B on interface 140B).

Figure 2:
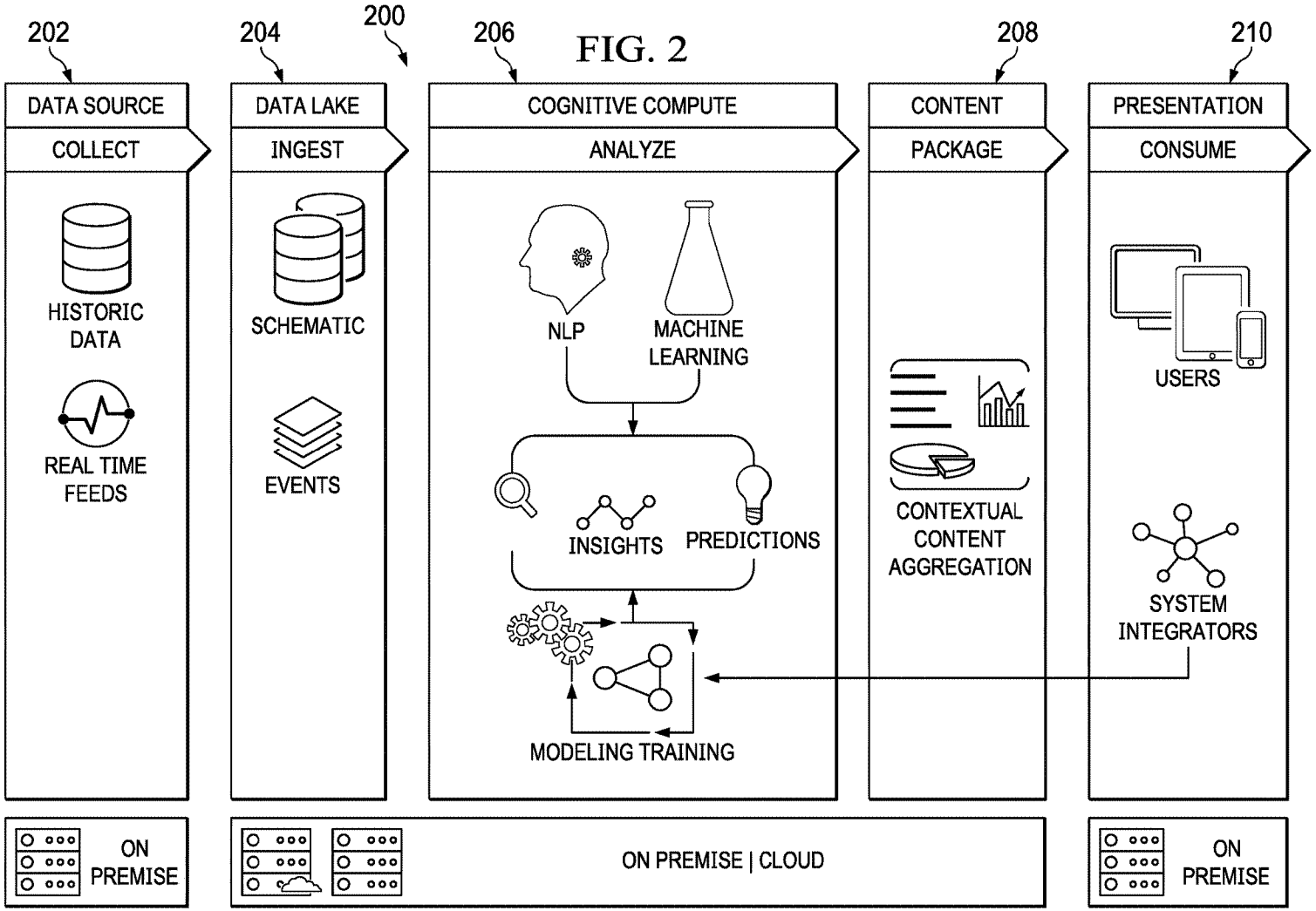
FIG. 2 schematically depicts the architecture of a gaming analytics computing system in accordance with the present disclosure.

FIG. 2 schematically depicts the architecture 200 of a gaming analytics computing system in accordance with one non-limiting embodiment. The architecture can include data sources 202 which provide relevant data such as, for example, historic data and real time feeds. The data from the data sources 202 can be ingested into a data warehouse, schematically shown as a data lake 204. The data can then be analyzed 206 in accordance with the system and methods described herein. Using a combination of natural language processing and machine learning, along with trained models, predictions based on the data can be determined and insights developed. The content 208 can then be contextually aggregated for presentation 210 to users. In accordance with various embodiments the architecture 200 can present the content 208 based on the preferences of the user 142 (FIG. 1). For instance, certain users can view the visualization (such as visualization 146 in FIG. 1) as a bar chart, while other users can view the same data in a different visualization based on their preferences. In addition, the visualization type can be determined by the type of information that is presented and the context of the question asked by the user. These preferences can be stored by the system per user.

Figure 3:
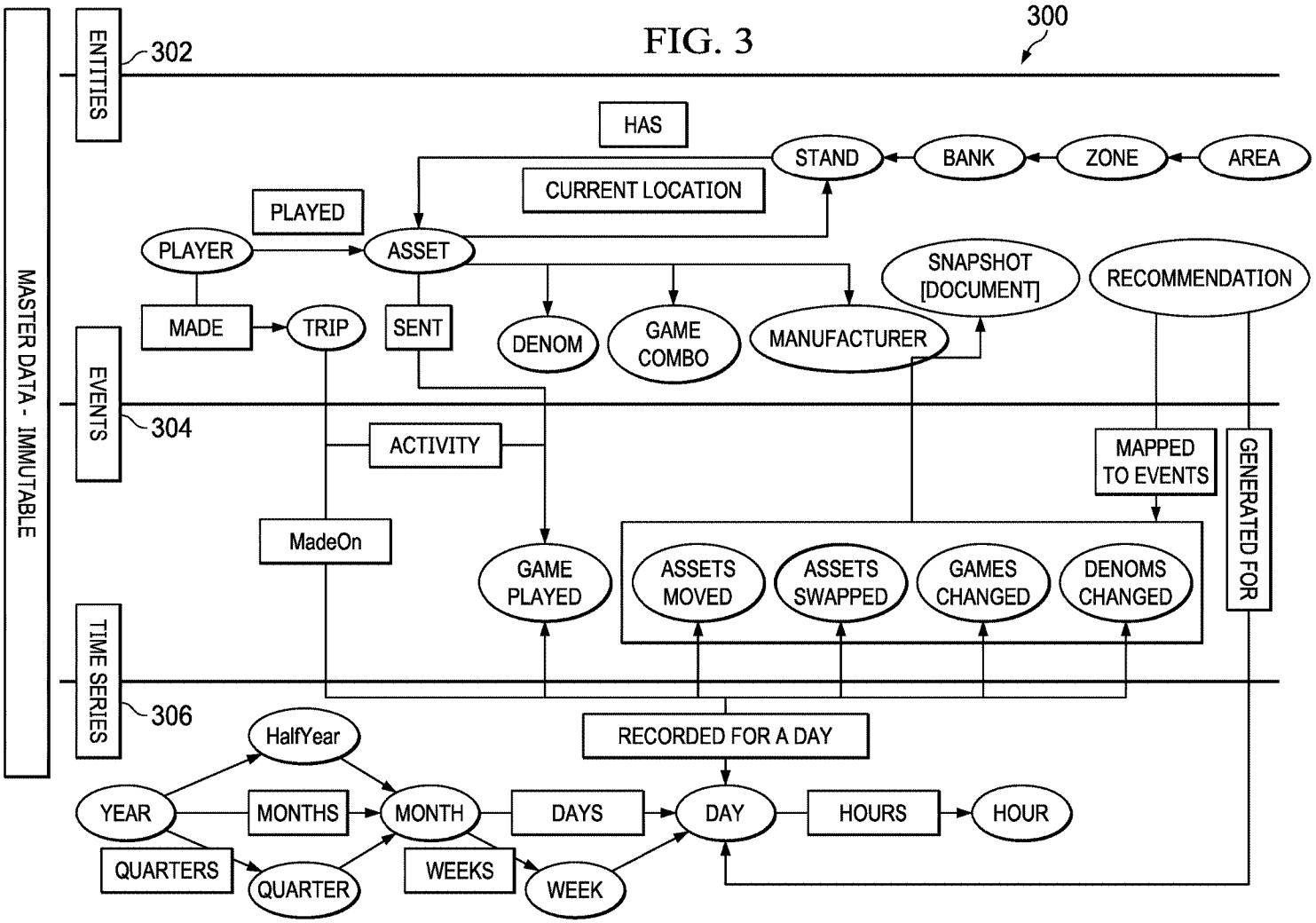
FIG. 3 schematically represents a data model in accordance with the present disclosure.

FIG. 3 schematically represents a data model 300 in accordance with the present disclosure. As shown, the data model 300 includes entities 302, such as players, gaming machines (shown as assets), which have various attributes associated therewith. The data model 300 also includes events 304 associated with the entities, such as data pertaining to when a player was at a particular gaming environment and what games they played. Other events are can be tracked as well, such as the movement of gaming machines and denomination changes, for example. Finally, various data stored within the data model 300 can be tied to appropriate time series 306 in order to provide the data modeling described herein.

Figure 4A:
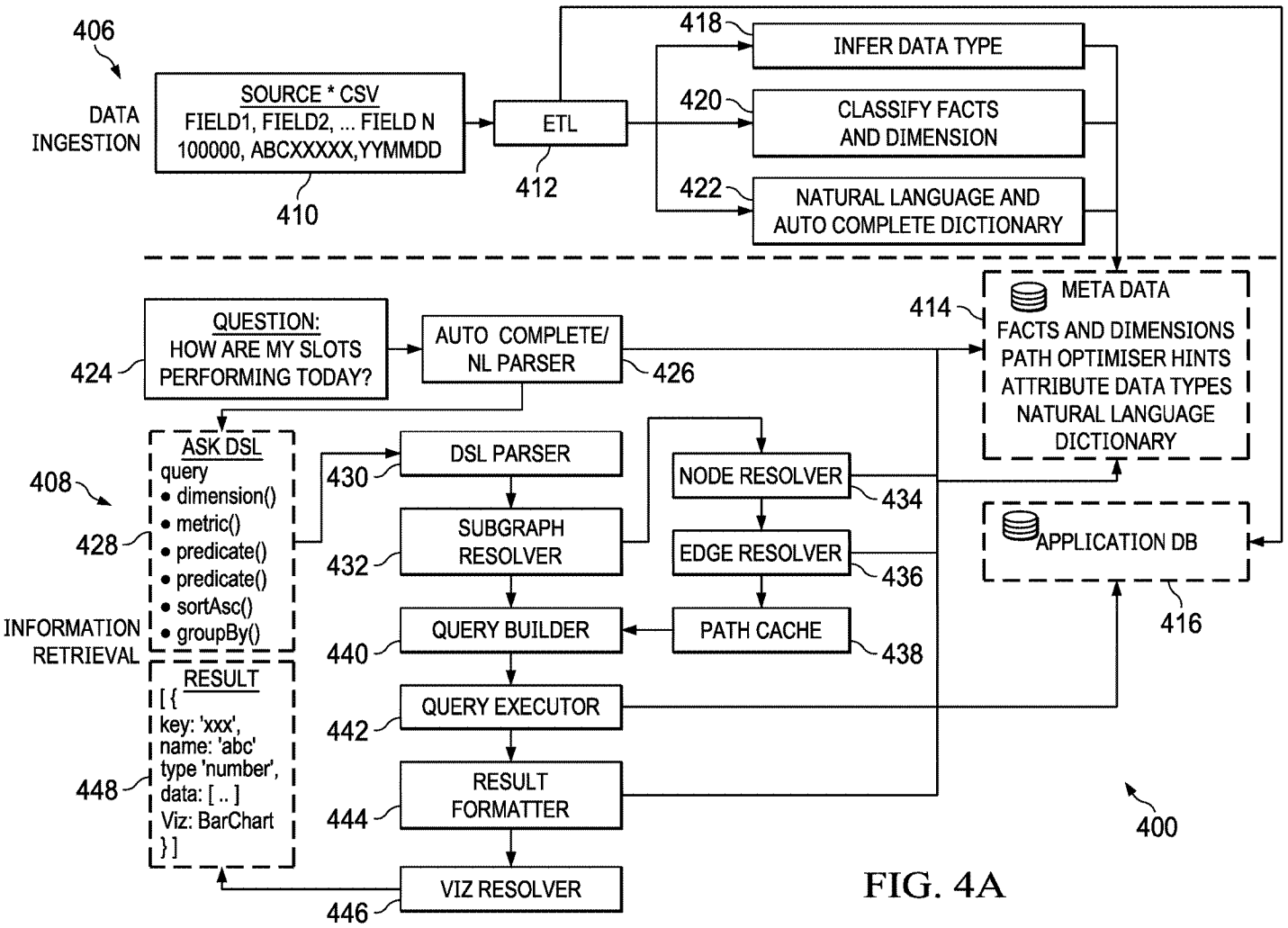

A gaming analytics computing system in accordance with the present disclosure can utilize a graph database as its core database for both storage and retrieval of analytical data. The gaming analytics computing system can provides a search driven interface for the user to query information. Generally, graph databases store data as nodes and edges. In accordance with the present disclosure, nodes can represent real world entities like gaming machines, players, game play, and so forth, while nodes contain attributes. Edges of the graph database represent the relationship between nodes (e.g., 'Asset IGT00001 was manufactured by IGT'). Example workflows 400, 450 of the complete process of storage and retrieval of analytical data are schematically depicted in FIGS. 4A-4B.

The workflow 400 is divided in to data ingestion 406 and information retrieval 408. Referring first to data ingestion 406, a gaming analytics computing system can ingest data from disparate systems. The data ingested can be gaming data and non-gaming data and can be supplied from gaming or non-gaming systems. In some cases, CSV (Comma Separated Value) files 410 are provided by the source systems. An extract, transform, load (ETL) process 412 can include two steps. It can build a metadata database 414 and then ingests data into the Application Database 416. The metadata database 414 consists of information about the data stored in the Application Database 416. The ETL process 412 can parse the source files to determine the data types 418 of the fields and also classify the data elements into facts and dimensions 420. Dimensions are entities (e.g., Player, Slots) and Facts are metrics about dimensions (e.g., Coin In, NetWin, Trips etc.,). The facts and dimensions are further used to build a natural language/auto complete dictionary 422. The metadata 414 can be used by the ETL process 412 to build a connected graph of nodes and edges for the source data. The ingested data is stored in the application database 416.

Referring now to information retrieval 408, a user can interact with the system by asking questions 424. As shown at processing block 452 in FIG. 4B, an example question is "All slots with NetWin greater than $10,000 this month by manufacturer." To help the user build relevant questions, the system can have an auto complete feature 426. Depending on the first letter typed, the system can show the next set of relevant words, depending on the first word typed, the system can show the next set of relevant words that the user can select from, and depending on the set of words, the system can show the next set of relevant sentences that the user can select from. Internally the system uses the natural language/auto complete dictionary 422 to determine the next set of relevant words. Additionally, in accordance with some embodiments, the system can provide predicted questions based on the user's historical interactions or the user's role. By way of an example, a user's role (i.e., based on log-in credentials) can determine the suggested questions presented to the user via an interface. Additionally, as the user requests for certain types of information, the system can anticipate and recommend additional questions that will assist the user in retrieving additional useful information.

Once the question is fully formed, it is submitted to the system for information retrieval. The NL Parser 426 can parse the question and converts that into a standardized internal object structure "ask DSL" (Domain Specific Language) 428, as shown by processing block 454 in FIG. 4B. The DSL Object is a simplified way of representing any query in a technology agnostic format. It can consists of a dimension, a collection of metrics of interest about the dimension, a list of predicates to filter the result, and optional qualifiers like group by and sort by fields. Queries that are sent to the system are first converted to the ask DSL format before further processing.

The ask DSL object 428 can then be sent to the DSL parser 430 for further processing. The DSL parser parses the query to perform sanity checks on the format, validity of facts, dimensions, predicates and so forth. A valid query is passed on to the subgraph resolver 432. The subgraph resolver 432 can use the metadata database 414 to convert the ask object 428 to a subgraph. Generally, the subgraph resolver 432 can perform the following steps. First, at 434 it maps dimensions, metrics, predicates to nodes in the application graph database 416 (processing block 456, FIG. 4B). Next, at 436, it determines relations (edges) that connects the nodes 416 (processing block 458, FIG. 4B). Finally, at 438, it connects dimension with all nodes to build the complete subgraph. For each metric that is part of the query, the system finds out the node that has the attribute(metric). Once a node is identified, it is added to the nodes list. The process continues until all the attributes (metrics predicates, group by, sort by) are resolved.

At this point, the process of connecting nodes with the edges can start. The subgraph resolver 432 can start with the dimension node and try to connect that with all the metric, predicate, group and sort nodes. Once a subgraph is built, it is passed on to the query builder 440 to build the graph database specific query. The query can then be converted to a specific query language and passed on to the query executor 442 to fetch data (processing block 460, FIG. 4B). The query is executed against the application database 416 (processing block 462, FIG. 4B). The output result can be formatted by the Result Formatter 444.

The system can also determine an appropriate visualization to present the result to the user. The visualization resolver 446 can use the number of the metrics and other usage data to determine a set of visualizations that can be used by the interface to present the information to the user (such as using data visualization 146 in FIG. 1). The result 448 is finally rendered on the screen of a user interface. It is noted that most part of the processing described above involves resolving information dynamically and rely heavily on the meta data. To optimize processing time, meta data, resolved subgraphs can be cached.

Figure 5:
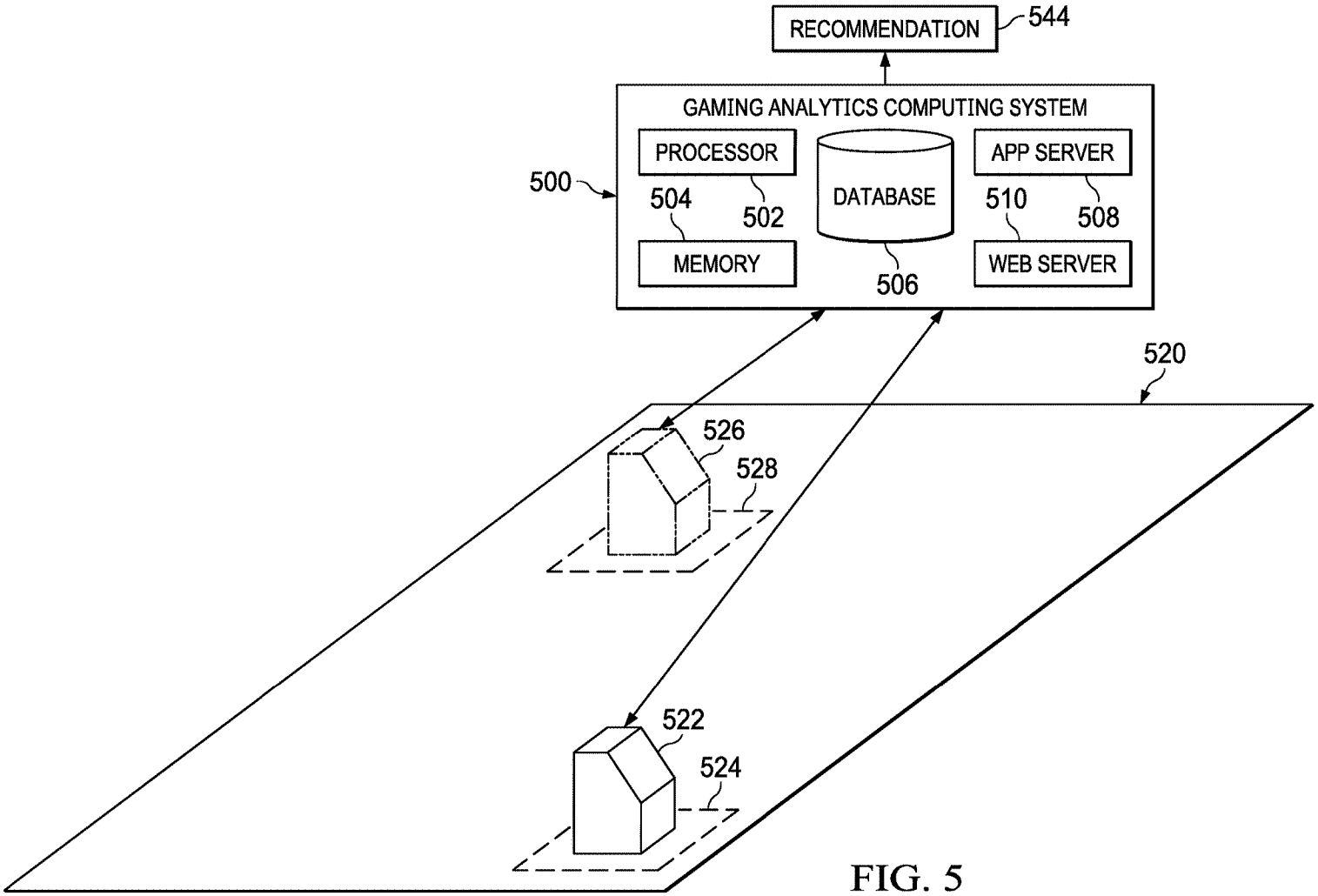
FIGS. 5-6 schematically depict example operational use cases in accordance with various non-limiting embodiments.

FIGS. 5-6 schematically depict example operational use cases in accordance with various non-limiting embodiments. Referring first to FIG. 5, a gaming analytics computing system 500 is shown, which can be similar to the gaming analytics computing system 100 of FIG. 1. As such, it can have one or more processors 502 and one or more computer memory units 504. The gaming analytics computing system 500 can also include a database 506, which can include the databases illustrated in FIG. 4A, for example. The gaming analytics computing system 500 can also have an application server 508 and/or a web server 510.

The gaming analytics computing system 500 can be associated with a gaming environment 520 within which gaming devices are operational. As shown, an existing gaming machine 522 is operational at a current location 524. In accordance with the present disclosure, the gaming analytics computing system 500 can determine a performance prediction at the current location 524 based on a current configuration of the existing gaming machine 522. Using the data analytics techniques described above, the gaming analytics computing system 500 can also predict performance of the gaming machine 522 if placed at a hypothetical location, shown as gaming machine 528 at a hypothetical location 528. Based on the performance prediction of the existing gaming machine 522 at the current location 524 and the hypothetical location 528, the gaming analytics computing system 500 can cause to be displayed on an interface a recommendation 544. The recommendation 544 can be, for example, to relocate the existing machine 522 to the hypothetical location 528. The recommendation 544 can include a quantification that supports the decisioning behind the recommendation.

Referring now to FIG. 6, a gaming analytics computing system 600 is shown, which can be similar to the gaming analytics computing system 100 of FIG. 1. As such, it can have one or more processors 602 and one or more computer memory units 604. The gaming analytics computing system 600 can also include a database 606, which can include the databases illustrated in FIG. 4A, for example. The gaming analytics computing system 600 can also have an application server 608 and/or a web server 610.

The gaming analytics computing system 600 can be associated with a gaming environment 620, within which gaming devices are operational. As shown, an existing gaming machine 622 is operational having a particular configuration. The gaming analytics computing system 600 can determine a performance prediction for the existing gaming machine 622 based on its configuration. In accordance with the present disclosure, the gaming analytics computing system 600 can determine, for each of a plurality hypothetical gaming machines 626A-C having varying configurations, a performance prediction. Based on an assessment of the performance prediction of the existing gaming machine 622 and the performance prediction of each hypothetical gaming machine 626A-C, the gaming analytics computing system 600 can cause to be displayed on an interface a recommendation 644. The recommendation 644 can be, for example, to replace the existing machine 622 to with a gaming machine having the same configuration as one of the hypothetical gaming machines 626A-C. The recommendation 644 can include a quantification that supports the decisioning behind the recommendation.

The systems and methods described herein can utilize an intuitive interface that is supported by natural language processing and artificial intelligence. As described, based on the predictive analytics, operational recommendations can be provided by the system through the interface to allow casino operators to improve service players, drive loyalty, increase profits, and improve cost savings. In some implementations, the interface provides reporting capabilities, as well as projections, predictions, and recommendations designed to best improve operational key performance indicators.

FIGS. 7-14 provide example non-limiting interfaces 740 that can be presented by a gaming analytics computing system 700. The gaming analytics computing system 700 can be similar to the gaming analytics computing system 100 of FIG. 1. As such, it can have one or more processors 702 and one or more computer memory units 704. The gaming analytics computing system 700 can also include a database 706, which can include the databases illustrated in FIG. 4A, for example. The gaming analytics computing system 700 can also have an application server 708 and/or a web server 710.

Figure 7:
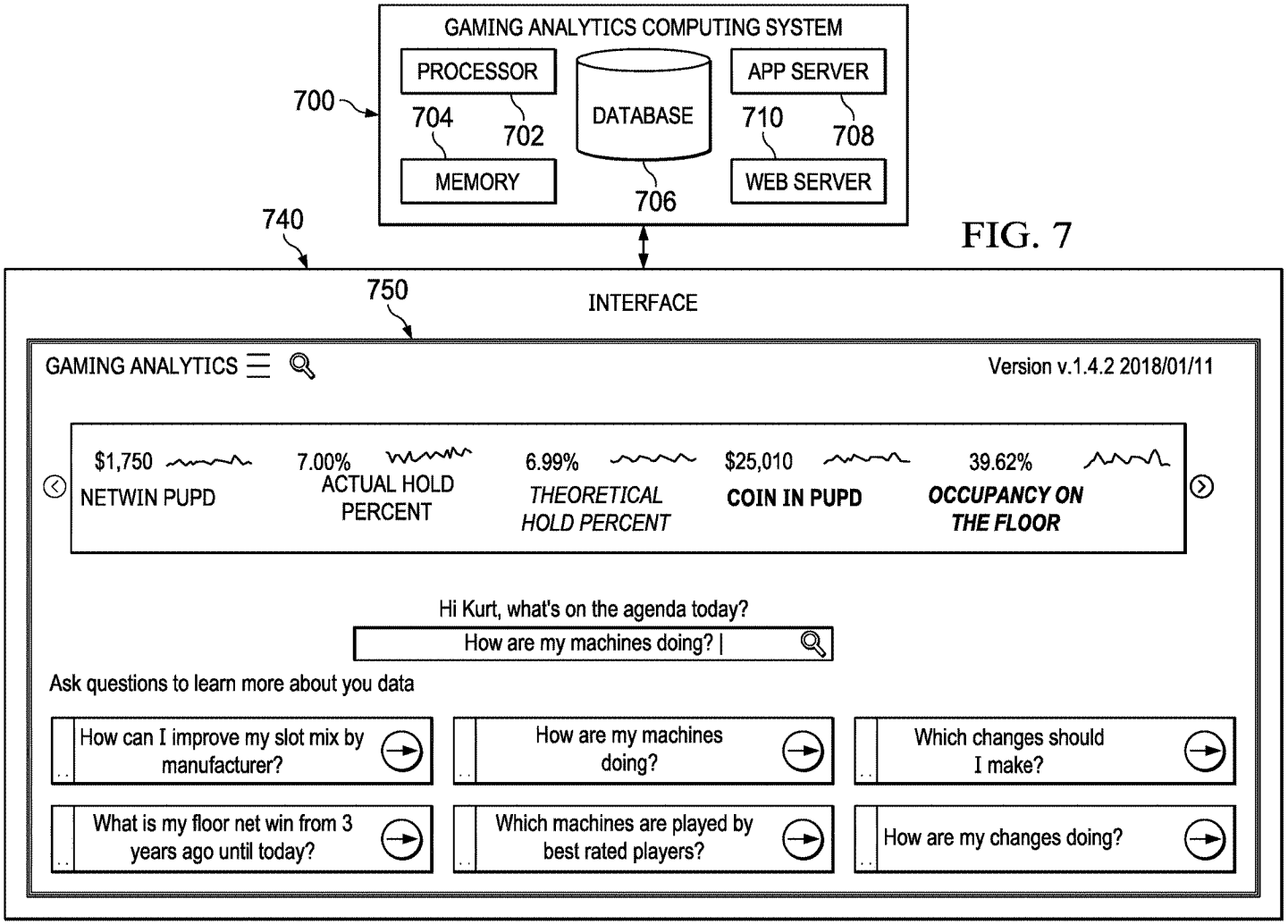
Figure 8:
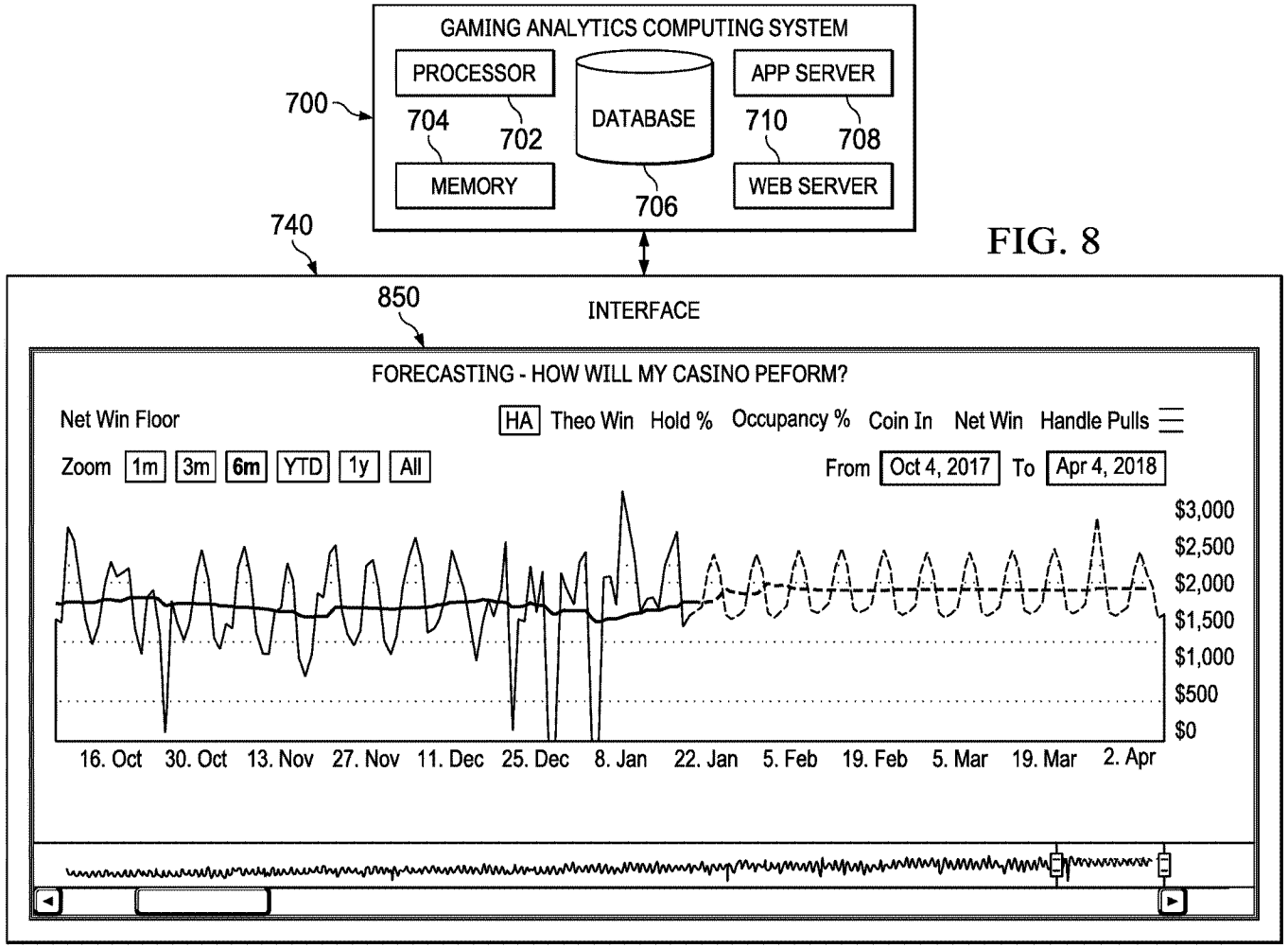
Figure 9:
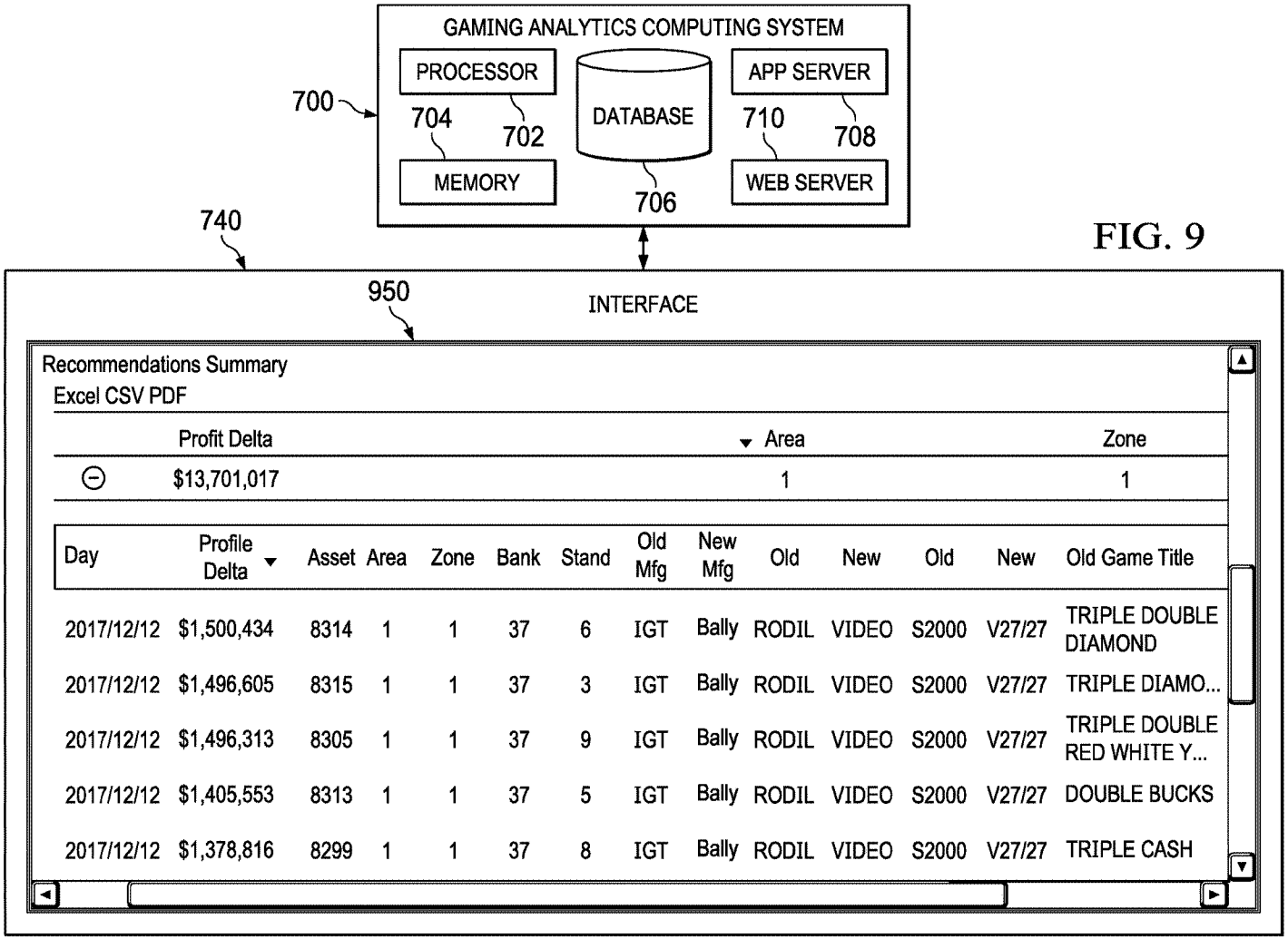
Figure 10:
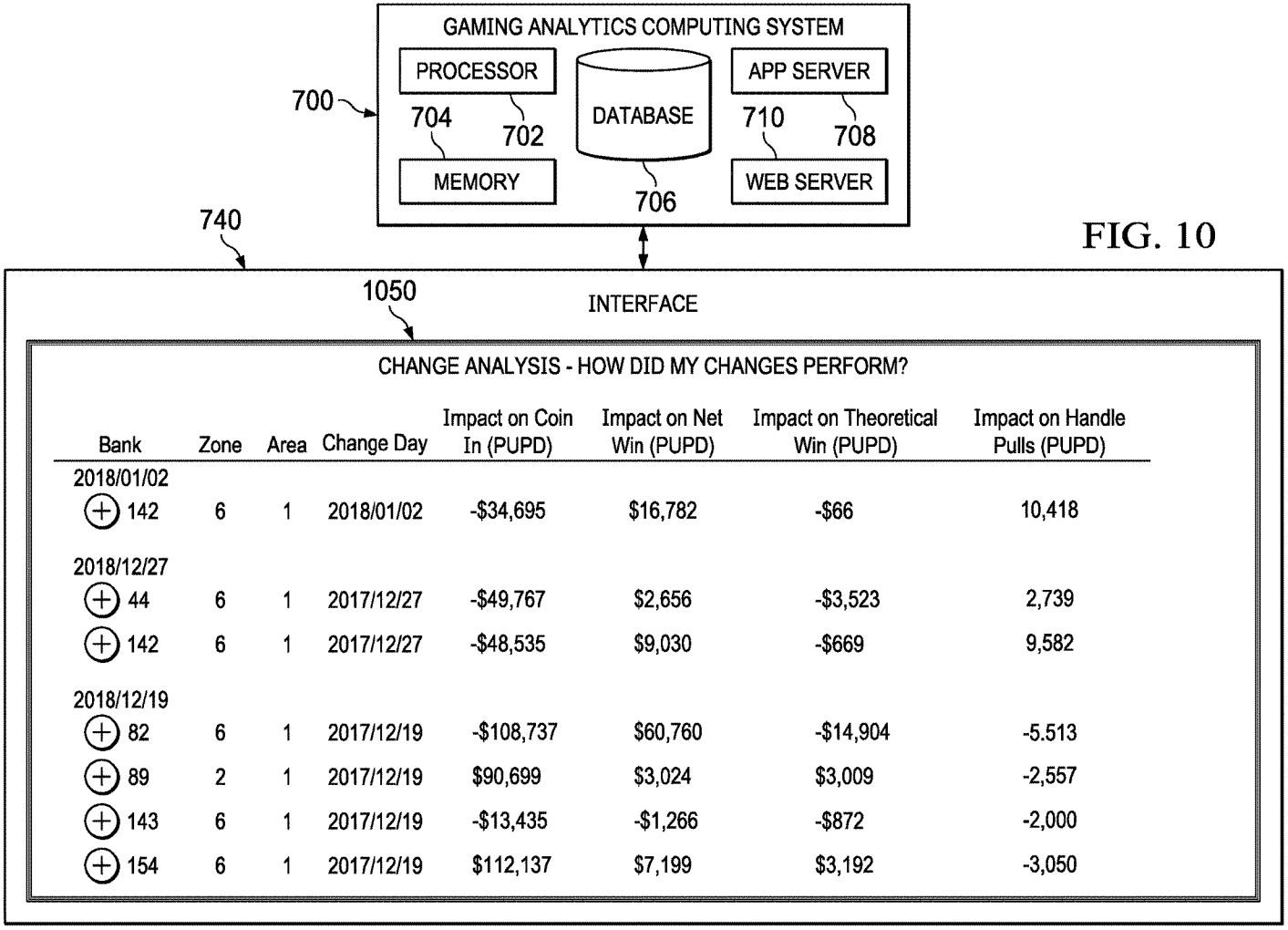
Figure 11A:
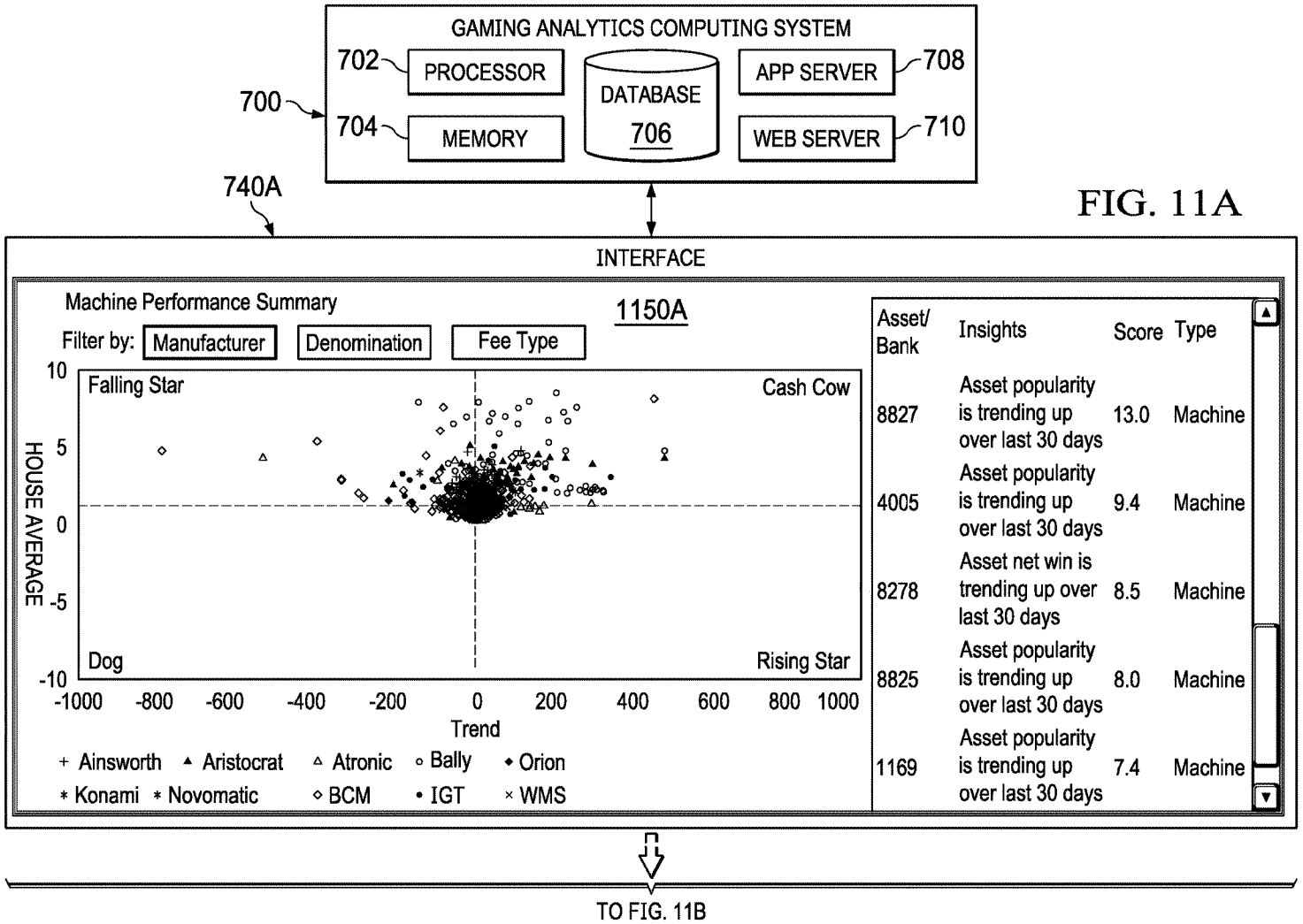
Figure 11B:
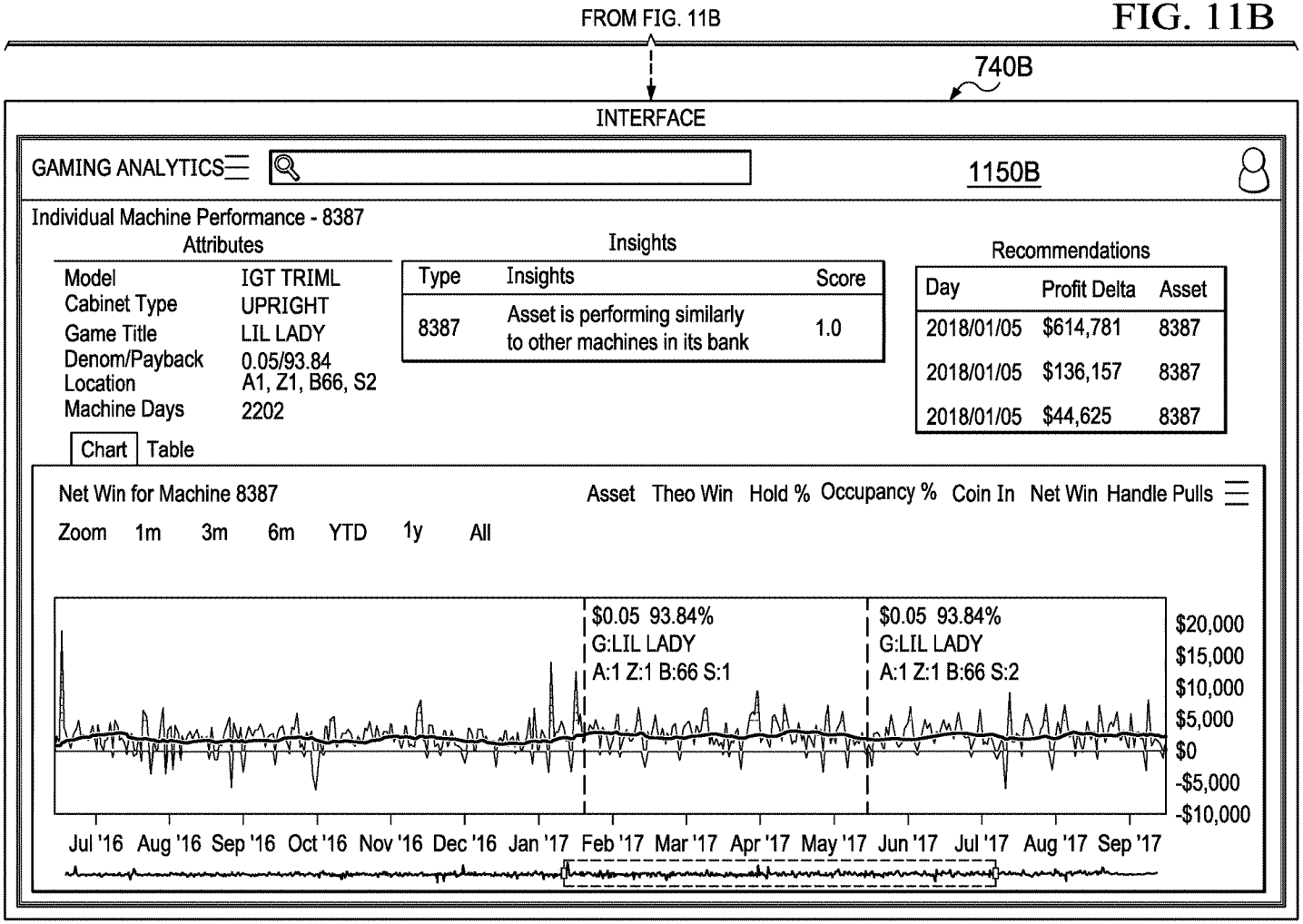
Figure 12:
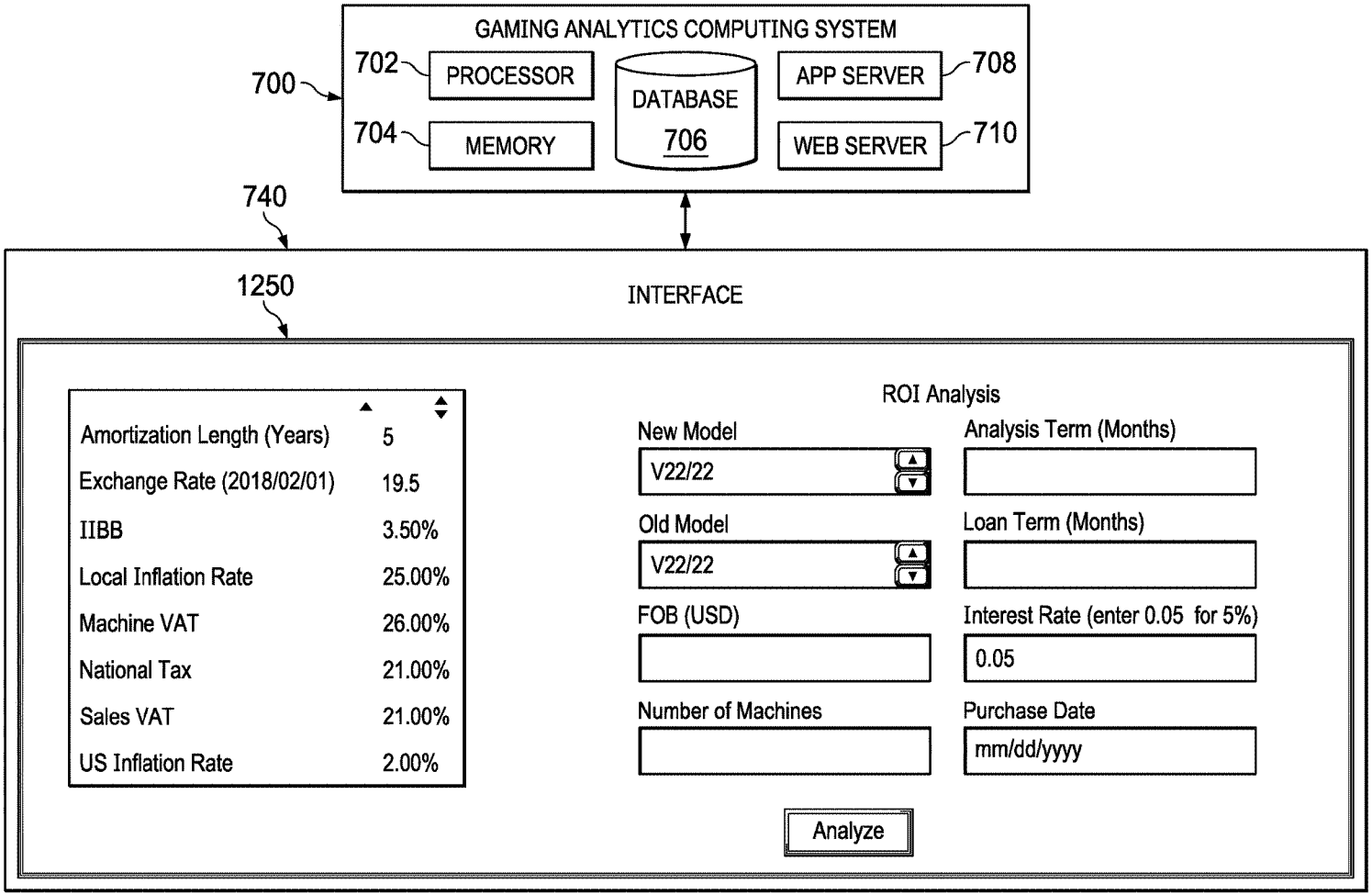
Figure 14:
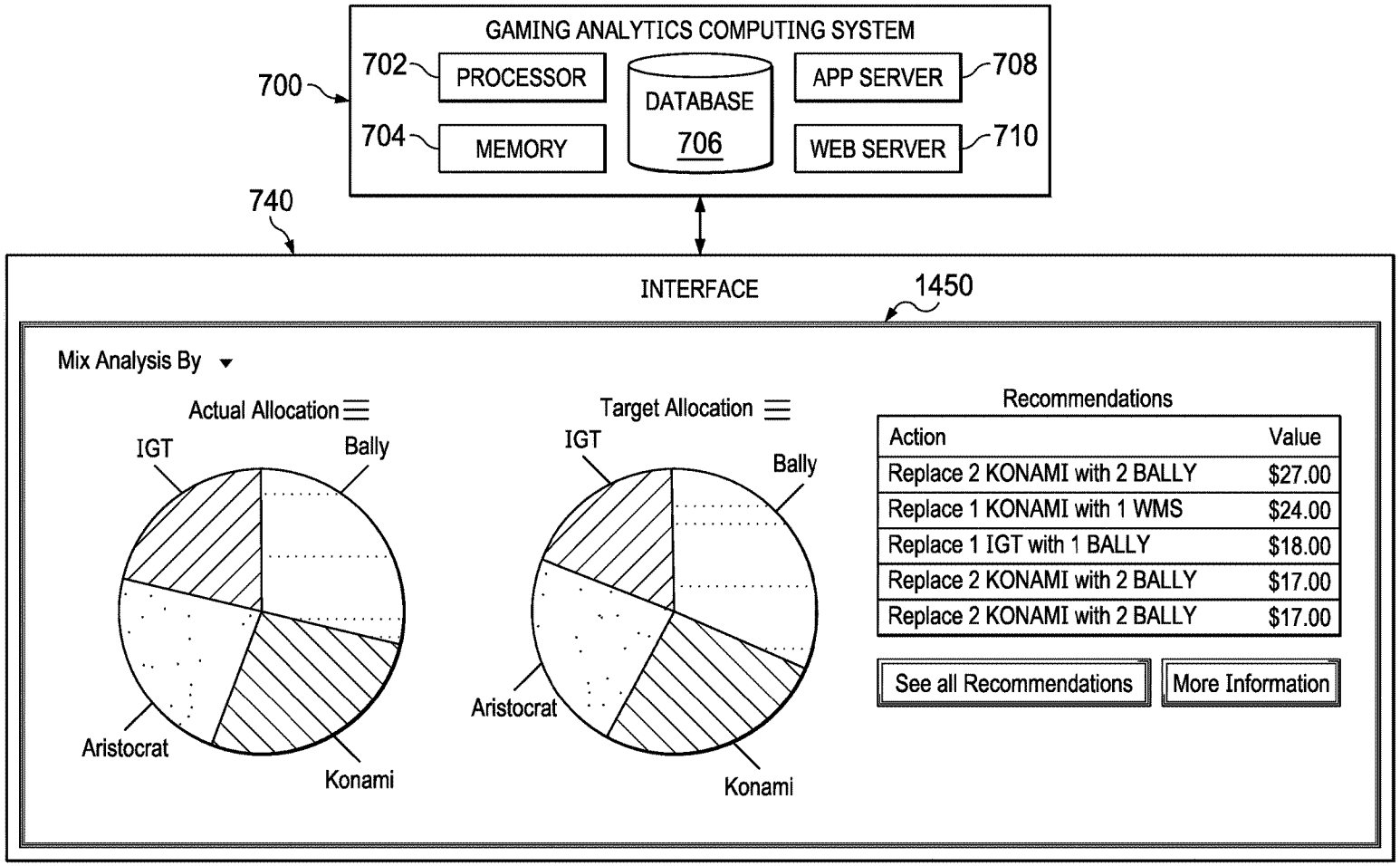

FIG. 7 depicts an example home screen 750 for a user that is generated by the gaming analytics computing system 700. The home screen 750 can include one or more pre-loaded questions to aid the user in navigating the system. The home screen 750 can also receive natural language queries entered by a user into the search bar. FIG. 8 depicts an example forecasting screen 850 generated by the gaming analytics computing system 700. Based on the data analytics described herein, various events can be forecasted, such as theoretical win, hold percentage, occupancy percentage, coin in percentage, net win percentage, and handle pulls. FIG. 9 depicts a recommendation summary 950 informing the user as to which operational adjustments are recommended. FIG. 10 depicts a change analysis 1050 generated by the gaming analytics computing system 700. FIG. 11 depicts an example machine performance summary 1150A on the interface 740A that is generated by the gaming analytics computing system 700. As shown by the interface 740B, a user can drill down to receive an individual machine performance summary 1150B. FIG. 12 depicts an example Return on Investment (ROI) analysis 1250 that is generated by the gaming analytics computing system 700. FIG. 13 depicts an example marketing analysis 1350 that is generated by the gaming analytics computing system 700. FIG. 14 depicts an example gaming machine mix allocation that is generated by the gaming analytics computing system 700.

In general, it will be apparent to one of ordinary skill in the art that at least some of the embodiments described herein can be implemented in many different embodiments of software, firmware, and/or hardware. The software and firmware code can be executed by a processor or any other similar computing device. The software code or specialized control hardware that can be used to implement embodiments is not limiting. For example, embodiments described herein can be implemented in computer software using any suitable computer software language type, using, for example, conventional or object-oriented techniques. Such software can be stored on any type of suitable computer-readable medium or media, such as, for example, a magnetic or optical storage medium. The operation and behavior of the embodiments can be described without specific reference to specific software code or specialized hardware components. The absence of such specific references is feasible, because it is clearly understood that artisans of ordinary skill would be able to design software and control hardware to implement the embodiments based on the present description with no more than reasonable effort and without undue experimentation.

Moreover, the processes described herein can be executed by programmable equipment, such as computers or computer systems and/or processors. Software that can cause programmable equipment to execute processes can be stored in any storage device, such as, for example, a computer system (nonvolatile) memory, an optical disk, magnetic tape, or magnetic disk. Furthermore, at least some of the processes can be programmed when the computer system is manufactured or stored on various types of computer-readable media.

It can also be appreciated that certain portions of the processes described herein can be performed using instructions stored on a computer-readable medium or media that direct a computer system to perform the process steps. A computer-readable medium can include, for example, memory devices such as diskettes, compact discs (CDs), digital versatile discs (DVDs), optical disk drives, or hard disk drives. A computer-readable medium can also include memory storage that is physical, virtual, permanent, temporary, semi-permanent, and/or semi-temporary.

A "computer," "computer system," "host," "server," or "processor" can be, for example and without limitation, a processor, microcomputer, minicomputer, server, mainframe, laptop, personal data assistant (PDA), wireless e-mail device, cellular phone, pager, processor, fax machine, scanner, or any other programmable device configured to transmit and/or receive data over a network. Computer systems and computer-based devices disclosed herein can include memory for storing certain software modules used in obtaining, processing, and communicating information. It can be appreciated that such memory can be internal or external with respect to operation of the disclosed embodiments.

In various embodiments disclosed herein, a single component can be replaced by multiple components and multiple components can be replaced by a single component to perform a given function or functions. Except where such substitution would not be operative, such substitution is within the intended scope of the embodiments. The computer systems can comprise one or more processors in communication with memory (e.g., RAM or ROM) via one or more data buses. The data buses can carry electrical signals between the processor(s) and the memory. The processor and the memory can comprise electrical circuits that conduct electrical current. Charge states of various components of the circuits, such as solid state transistors of the processor(s) and/or memory circuit(s), can change during operation of the circuits.

Some of the figures can include a flow diagram. Although such figures can include a particular logic flow, it can be appreciated that the logic flow merely provides an exemplary implementation of the general functionality. Further, the logic flow does not necessarily have to be executed in the order presented unless otherwise indicated. In addition, the logic flow can be implemented by a hardware element, a software element executed by a computer, a firmware element embedded in hardware, or any combination thereof.

The foregoing description of embodiments and examples has been presented for purposes of illustration and description. It is not intended to be exhaustive or limiting to the forms described. Numerous modifications are possible in light of the above teachings. Some of those modifications have been discussed, and others will be understood by those skilled in the art. The embodiments were chosen and described in order to best illustrate principles of various embodiments as are suited to particular uses contemplated. The scope is, of course, not limited to the examples set forth herein, but can be employed in any number of applications and equivalent devices by those of ordinary skill in the art. Rather it is hereby intended the scope of the invention to be defined by the claims appended hereto.

We claim:

1. A computer system including a processor and a memory, the memory containing software instructions configuring the system to perform acts including:

receive gaming machine data for each of plurality of gaming machines of a gaming environment, wherein the gaming machine data comprises one or more of an amount of bets, a gaming machine denomination amount, a gaming machine location, and a number of games played;

based at least partially on the gaming machine data, generate a model to determine an expected value for each of a plurality of game types, wherein the gaming machine data is normalized to account for one or more of yearly trends, monthly trends, and weekly trends;

for one or more specified locations within the gaming environment, calculate an expected value for each of the plurality of game types based on the generated model;

cause to be displayed on an interface a recommendation to replace one of the plurality of gaming machines with a different gaming machine, wherein the recommendation is based on the calculated expected values of the one of the plurality of gaming machines and the different gaming machine determined by the generated model;

cause to be displayed on the interface a data visualization scheme selected from a plurality of data visualization schemes based on the recommendation; and cause to be displayed on the interface a quantification of the recommendation to replace one of the plurality of gaming machines with a different gamine machine, wherein the quantification comprises a value of the recommendation based on the calculated expected value of the one of the plurality gaming machine and the calculated expected value of the different gaming machine determined by the generated model.

2. The computer system of claim 1, wherein the recommendation further comprises an operational adjustment, wherein the operational adjustment is any of a gaming machine replacement, a denomination change, a payback percent change, game title change, a location change, and a game type change.

3. The computer system of claim 1, wherein the one of the plurality of gaming machines is an existing gaming machine positioned at a current location within the gaming environment and the different gaming machine is a hypothetical gaming machine having a different configuration than the current configuration of the existing gaming machine, wherein the software instructions further configure the system to perform acts including:

determine with the generated model a performance prediction at the current location of the existing gaming machine based on a current configuration of the existing gaming machine;

determine with the generated model a performance prediction of the hypothetical machine at the location; and wherein the recommendation to replace the existing gaming machine with the hypothetical gaming machine is based on the performance prediction of the existing gaming machine and the performance prediction of the hypothetical gaming machine.

4. The computer system of claim 3, wherein the software instructions further configure the system to perform acts including:

cause to be displayed on the interface a data visualization of the performance prediction of the existing gaming machine and the performance prediction of the hypothetical gaming machine.

5. The computer system of claim 3, wherein the software instructions further configure the system to perform acts including:

for each of a plurality of different hypothetical gaming machines, each having a different configuration than the current configuration of the existing gaming machine and a different configuration than each other, determine with the generated model a performance prediction of each of the hypothetical machines at the location; and based on the performance prediction of the existing gaming machine and the performance prediction of each of the hypothetical gaming machines, cause to be displayed on the interface a recommendation to replace the existing gaming machine with the replacement gaming machine, wherein the replacement gaming machine has the configuration of one of the plurality of hypothetical gaming machines.

6. The computer system of claim 1, wherein the software instructions further configure the system to perform acts including:

for an existing gaming machine positioned at a location within the gaming environment, determine with the generated model a performance prediction at the current location of the existing gaming machine based on a current configuration of the existing gaming machine, wherein the existing gaming machine is one of the plurality of gaming machines;

for the existing gaming machine, determine with the generated model a performance prediction of the existing gaming machine at a hypothetical location within the gaming environment, wherein the hypothetical location is different than the current location; and based on the performance prediction of the existing gaming machine at the current location and the performance prediction of the existing gaming machine at the hypothetical location, cause to be displayed on the interface a recommendation to relocate the existing gaming machine to the hypothetical location.

7. The computer system of claim 1, wherein the gaming machine data comprises one or more of a gaming machine identifier, a gaming machine manufacturer, and gaming machine location information.

8. The computer system of claim 7, wherein the location information comprises a seat type and a bank shape.

9. The computer system of claim 1, wherein the memory containing software instructions configuring the system to determine with the generated model any of a theoretical win metric, a net win metric, a coin in metric, a coin out metric, a jackpot metric, an average bet metric, a hold percentage metric, a number of card players metric, and a number of visits metric.

10. The computer system of claim 9, wherein the theoretical win metric is a product of a par percentage of the gaming machine and amount of amount of funds provided by a player to the gaming machine, the par percentage is 1 minus a return to player, and the return to the player is an expected payment divided by wager size.

11. The computer system of claim 1, wherein the recommendation further comprises a recommended mix of gaming machine type based on at least one gaming machine factor.

12. The computer system of claim 11, wherein the at least one gaming machine factor is any of a manufacturer, a gaming machine denomination, a gaming machine payback percentage, a gaming machine game title, and a game type.

13. The computer system of claim 2, wherein the operational adjustment is recommended maintenance to a hardware component of one of the plurality of gaming devices.

14. The computer system of claim 1, wherein the software instructions further configure the system to perform acts including:

receive a natural language query provided through a query interface;

for the natural language query, determine an intent of the query, wherein the intent of query comprises a verb, a fact, and a dimension.

15. The computer system of claim 14, wherein the software instructions further configure the system to perform acts including:

based on the determined intent of the query, map the intent to one or more questions; and request via an application programming interface call, data to answer the one or more questions.

16. A non-transitory computer readable medium containing software instructions for configuring a computer system programmed thereby to perform acts including:

receiving gaming machine data for each of plurality of gaming machines of a gaming environment, wherein the gaming machine data comprises one or more of an amount of bets, a gaming machine denomination amount, a gaming machine location, and a number of games played;

based at least partially on the gaming machine data, generating a model to determine an expected value for each of a plurality of game types, wherein the gaming machine data is normalized to account for one or more of yearly trends, monthly trends, and weekly trends;

for one or more specified locations within the gaming environment, calculating an expected value for each of the plurality of game types based on the generated model;

causing to be displayed on an interface a recommendation to replace one of the plurality of gaming machines with a different gaming machine, wherein the recommendation is based on the calculated expected values of the one of the plurality of gaming machines and the different gaming machine determined by the generated model;

causing to be displayed on the interface a data visualization scheme selected from a plurality of data visualization schemes based on the recommendation; and causing to be displayed on the interface a quantification of the recommendation to replace one of the plurality of gaming machines with a different gaming machine, wherein the quantification comprises a value of the recommendation based on the calculated expected value of the one of the plurality gaming machine and the calculated expected value of the different gaming machine determined by the generated model.

17. The non-transitory computer readable medium of claim 16, wherein the the software instructions further configure the computer system programmed thereby to perform acts comprising determining with the generated model any of a theoretical win metric, a net win metric, a coin in metric, a coin out metric, a jackpot metric, an average bet metric, a hold percentage metric, a number of card players metric, and a number of visits metric.

18. A method, comprising:

receiving, by a gaming machine analytics computing system, gaming machine data for each of plurality of gaming machines of a gaming environment, wherein the gaming machine data comprises one or more of an amount of bets, a gaming machine denomination amount, a gaming machine location, a number of games played, gaming machine model, gaming machine manufacturer, game machine title, player identities, loyalty levels of players;

based at least partially on the gaming machine data, generating a model to determine an expected value for each of a plurality of game types, wherein the gaming machine data is normalized to account for one or more of yearly trends, monthly trends, and weekly trends;

for one or more specified locations within the gaming environment, calculating an expected value for each of the plurality of game types based on the generated model;

causing, by the gaming machine analytics computing system, a recommendation to be displayed on an interface, wherein the recommendation is to replace one of the plurality of gaming machines with a different gaming machine, wherein the recommendation is based on the calculated expected values of the one of the plurality of gaming machines and the different gaming machine determined by the generated model;

causing, by the gaming machine analytics computing system, a data visualization scheme to be displayed on the interface, wherein the data visualization scheme is selected from a plurality of data visualization schemes based on the recommendation; and causing, by the gaming machine analytics computing system, a quantification of the recommendation to replace one of the plurality of gamine machines with a different gaming machine to be displayed on the interface.

19. The method of claim 18, wherein the recommendation further comprises an operational adjustment, wherein the operational adjustment is any of a gaming machine replacement, a denomination change, a payback percent change, a title change, a location change, and a game type change, and a game model change.

20. The method of claim 18, wherein the gaming machine analytics computing system is remote from the plurality of machines and the gaming environment.

21. The method of claim 18, further comprising:

receiving, by the gaming machine analytics computing system, a natural language query.

22. The method of claim 21, wherein the recommendation is based on the parsing of the natural language query.

23. The method of claim 22, further comprising:

based on the parsing of the natural language query, retrieving a query result from a database, wherein the database is a graph database.

24. The method of claim 18, further comprising determining with the generated model any of a theoretical win metric, a net win metric, a coin in metric, a coin out metric, a jackpot metric, an average bet metric, a hold percentage metric, a number of card players metric, and a number of visits metric.

25. The method of claim 24, wherein the theoretical win metric is a product of a par percentage of the gaming machine and amount of amount of funds provided by a player to the gaming machine, the par percentage is 1 minus a return to player, and the return to the player is an expected payment divided by wager size.

26. The computer system of claim 1, wherein at least some of the gaming machine data is received in a substantially real-time data stream.

* * * * *